US008363297B2

(12) United States Patent
Soeda et al.

(10) Patent No.: US 8,363,297 B2
(45) Date of Patent: Jan. 29, 2013

(54) OPTICAL SCANNING DEVICE AND IMAGE FORMING APPARATUS

(75) Inventors: Masahiro Soeda, Kanagawa (JP); Tomohiro Nakajima, Kanagawa (JP)

(73) Assignee: Ricoh Company, Tokyo (JP)

( * ) Notice: Subject to any disclaimer, the term of this patent is extended or adjusted under 35 U.S.C. 154(b) by 391 days.

(21) Appl. No.: 12/396,744

(22) Filed: Mar. 3, 2009

(65) Prior Publication Data

US 2009/0225383 A1 Sep. 10, 2009

(30) Foreign Application Priority Data

Mar. 7, 2008 (JP) ..... 2008-057226

(51) Int. Cl.
*G02B 26/08* (2006.01)

(52) U.S. Cl. ..... 359/198.1; 347/246

(58) Field of Classification Search ..... 359/198.1, 359/199.1, 201.1, 201.2, 204.1, 204.2; 347/246–250, 347/256

See application file for complete search history.

(56) References Cited

U.S. PATENT DOCUMENTS

| | | | |
|---|---|---|---|
| 4,853,710 | A | 8/1989 | Shimada et al. |
| 5,633,744 | A | 5/1997 | Nakajima |
| 5,671,077 | A | 9/1997 | Imakawa et al. |
| 5,753,907 | A | 5/1998 | Nakajima et al. |
| 5,786,594 | A | 7/1998 | Ito et al. |
| 5,793,408 | A | 8/1998 | Nakajima |
| 5,926,203 | A | 7/1999 | Shimura et al. |
| 5,936,756 | A | 8/1999 | Nakajima |
| 5,999,345 | A | 12/1999 | Nakajima et al. |
| 6,052,211 | A | 4/2000 | Nakajima |
| 6,091,534 | A | 7/2000 | Nakajima |
| 6,621,512 | B2 | 9/2003 | Nakajima et al. |
| 6,657,765 | B2 | 12/2003 | Hayashi et al. |
| 6,775,041 | B1 | 8/2004 | Nakajima |
| 6,788,444 | B2 | 9/2004 | Suzuki et al. |
| 6,839,157 | B2 | 1/2005 | Ono et al. |
| 6,867,890 | B2 | 3/2005 | Suzuki et al. |
| 6,932,271 | B2 | 8/2005 | Nakajima et al. |
| 6,972,883 | B2 | 12/2005 | Fujii et al. |
| 6,995,885 | B2 | 2/2006 | Nakajima |
| 7,068,296 | B2 | 6/2006 | Hayashi et al. |
| 7,075,688 | B2 | 7/2006 | Nakajima |
| 7,170,660 | B2 | 1/2007 | Nakajima |
| 7,221,493 | B2 | 5/2007 | Fujii et al. |
| 7,224,380 | B2 * | 5/2007 | Yamaguchi et al. ..... 347/247 |
| 7,333,254 | B2 | 2/2008 | Amada et al. |

(Continued)

FOREIGN PATENT DOCUMENTS

| | | |
|---|---|---|
| JP | 2924200 | 5/1999 |
| JP | 3011144 | 12/1999 |

(Continued)

*Primary Examiner* — Frank Font
(74) *Attorney, Agent, or Firm* — Oblon, Spivak, McClelland, Maier & Neustadt, L.L.P.

(57) ABSTRACT

An optical scanning device is disclosed that includes a light source unit, a light source drive unit, a deflection unit, a scanning image optical system, and a light beam detection unit. In the optical scanning device, the light source drive unit controls an amount of light emission of the light source unit, and a light emission amount control period in which the light source unit is forcibly turned OFF is set to the light source drive unit during a period from when the deflection unit deflects to an edge of a scanning angle for scanning the main scanning area to when the deflection unit deflects to a maximum deflection angle of the deflection unit within a non-image forming period.

13 Claims, 18 Drawing Sheets

U.S. PATENT DOCUMENTS

| | | | | |
|---|---|---|---|---|
| 7,411,712 | B2 | 8/2008 | Nakajima et al. | |
| 7,417,780 | B2 | 8/2008 | Fujii et al. | |
| 7,423,787 | B2 | 9/2008 | Nakajima | |
| 7,443,414 | B2 | 10/2008 | Nomura et al. | |
| 7,446,793 | B2 * | 11/2008 | Inagawa et al. | 347/236 |
| 7,453,615 | B2 | 11/2008 | Nakajima | |
| 7,468,824 | B2 | 12/2008 | Nakajima | |
| 7,471,306 | B2 | 12/2008 | Nakajima | |
| 7,495,813 | B2 | 2/2009 | Akiyama et al. | |
| 7,602,410 | B2 * | 10/2009 | Nomura et al. | 347/250 |
| 7,626,605 | B2 * | 12/2009 | Nomura et al. | 347/236 |
| 7,692,678 | B2 * | 4/2010 | Morisawa et al. | 347/235 |
| 7,719,559 | B2 * | 5/2010 | Sobue | 347/236 |
| 7,884,842 | B2 * | 2/2011 | Ishihara | 347/235 |
| 8,253,769 | B2 * | 8/2012 | Ono | 347/246 |
| 2003/0053156 | A1 | 3/2003 | Satoh et al. | |
| 2004/0036936 | A1 | 2/2004 | Nakajima et al. | |
| 2005/0062836 | A1 | 3/2005 | Nakajima | |
| 2005/0105156 | A1 | 5/2005 | Ono et al. | |
| 2005/0190420 | A1 | 9/2005 | Imai | |
| 2005/0243396 | A1 | 11/2005 | Fujii et al. | |
| 2006/0132880 | A1 | 6/2006 | Amada et al. | |
| 2006/0158711 | A1 | 7/2006 | Imai et al. | |
| 2006/0232660 | A1 | 10/2006 | Nakajima et al. | |
| 2007/0035796 | A1 | 2/2007 | Nakajima | |
| 2007/0058232 | A1 | 3/2007 | Nakajima | |
| 2007/0058255 | A1 | 3/2007 | Imai et al. | |
| 2007/0146738 | A1 | 6/2007 | Nakajima | |
| 2007/0146851 | A1 | 6/2007 | Nakajima | |
| 2007/0146856 | A1 | 6/2007 | Nakajima | |
| 2007/0206259 | A1 | 9/2007 | Nakajima | |
| 2008/0024590 | A1 | 1/2008 | Nakajima | |
| 2008/0062491 | A1 | 3/2008 | Nakamura et al. | |
| 2008/0117487 | A1 | 5/2008 | Amada et al. | |
| 2008/0192323 | A1 | 8/2008 | Nakamura et al. | |
| 2008/0204852 | A1 | 8/2008 | Amada et al. | |
| 2008/0212156 | A1 | 9/2008 | Nakajima | |
| 2008/0212999 | A1 | 9/2008 | Masuda et al. | |
| 2008/0239433 | A1 | 10/2008 | Amada et al. | |
| 2012/0212565 | A1 * | 8/2012 | Tomioka | 347/247 |

FOREIGN PATENT DOCUMENTS

| | | |
|---|---|---|
| JP | 2000-9589 | 1/2000 |
| JP | 3445691 | 6/2003 |
| JP | 3543473 | 4/2004 |
| JP | 3594813 | 9/2004 |
| JP | 2004-279947 | 10/2004 |
| JP | 2005-349621 | 12/2005 |
| JP | 2006-198881 | 8/2006 |
| JP | 2007-148356 | 6/2007 |
| JP | 2007-171854 | 7/2007 |

* cited by examiner

NO DEFORMATION

CONVEX DEFORMED

OPTICAL SCANNING DEVICE AND IMAGE FORMING APPARATUS

CROSS-REFERENCE TO RELATED APPLICATIONS

The present application claims priority under 35 U.S.C. §119 to Japanese Patent Application Publication No. 2008-057226 filed Mar. 7, 2008, the entire contents of which are hereby incorporated herein by reference.

BACKGROUND OF THE INVENTION

1. Field of the Invention

The present invention generally relates to an optical scanning device for scanning a light beam emitted from a light emitting section onto a target scanning surface. More particularly, the present invention relates to an optical scanning device capable of controlling a light amount to control a feedback light to a light emitting section of a light source of the optical scanning device.

2. Description of the Related Art

In conventional optical scanning devices, a polygon mirror or a galvanic mirror has been generally used as a deflector for scanning a light beam. On the other hand, there has been a growing demand for forming high-resolution images and fast printing. To that end, it is necessary to increase the rotation speed of the mirror. However, there is a limit of fast scanning by a method of rotating the mirror due to the durability of the bearing and heat and noise generated by windage loss.

To overcome the problem, research of a deflection device fabricated using silicon micromachining technology has been continually carried out. One method has been proposed in which a vibration mirror and a torsion beam axially supporting the vibration mirror are integrally formed on a Si substrate. The vibration mirror formed on the Si substrate may be called a MEMS (vibration) mirror, where MEMS stands for Micro Electro Mechanical Systems and refers to a device integrated on a Si substrate and the like.

According to the deflection method of the vibration mirror, the size of the mirror surface can be reduced and accordingly, the size of the vibration mirror can also be reduced; and the mirror is moved back and forth based at a resonance frequency and therefore, fast deflection can be achieved with lower noise and less consumption power. Further, the vibration becomes lower and little heat is generated, and therefore, the housing including the optical scanning device may become thinner. Further, even when low-cost resin forming material having a low blending ratio of glass fibers is used, the image quality is hardly degraded.

Patent Documents 1 and 2 disclose examples where the vibration mirror is used instead of the polygon mirror. However, the vibration mirror described in Patent Documents 1 and 2 may have problems that the resonance frequency may vary due to the change of the spring constant of the torsion beam supporting the vibration mirror and that the deflection angle of the vibration mirror may also vary due to the change of the viscosity resistance of air caused by the change of air pressure.

To overcome the problems, a technique is proposed, as disclosed in Patent Document 3, of stabilizing the deflection angle by detecting the deflection angle by detecting a scanned light beam in advance, and controlling a current applied to the vibration mirror.

Further, an optical scanning device using the vibration mirror, or an image forming apparatus is disclosed in, for example, Patent Documents 4 and 5.

According to the inventions described in Patent Documents 3 through 5, by using the vibration mirror instead of the polygon mirror, it becomes possible to reduce noise and energy consumption. Further, by using the vibration mirror as the optical deflector of the image forming apparatus, it becomes possible to provide an image forming apparatus suitable for an office environment. Further, the housing of the optical scanning device can be thinner due to lower vibration, and as a result, the cost and weight can also be reduced.

Patent Documents 6 and 9 are also prior art documents related to the present invention, though not all of the documents describe the vibration mirror used as the optical deflector. Patent documents 6 and 7 disclose a light beam characteristics measurement method and a device capable of estimating the depth of the characteristics required for the light beam.

Patent Document 8 discloses a technique in which a density unevenness of an image is reduced by controlling the APC light amount of plural light sources, i.e., a light amount, to be constant in a non image forming period but excluding a feedback light affecting period. Herein, the non image forming period refers to a period other than an image forming period.

Patent Document 9 discloses an invention in which, by not adjusting an amount of light of the light source at a timing when the incident angle of the light beam to the reflection surface of the polygon mirror which serves as an optical deflector is substantially 90 degrees, an initializing process of a photo detector (hereinafter referred to as "PD") can be stably carried out, the PD being incorporated in a light source section including a laser diode (hereinafter referred to as "LD") as a light source.

Patent Document 1: Japanese Patent No. 2924200
Patent Document 2: Japanese Patent No. 3011144
Patent Document 3: Japanese Patent No. 3445691
Patent Document 4: Japanese Patent No. 3543473
Patent Document 5: Japanese Patent Application Publication No. 2004-279947
Patent Document 6: Japanese Patent Application Publication No. 2000-9589
Patent Document 7: Japanese Patent No. 3594813
Patent Document 8: Japanese Patent Application Publication No. 2006-198881
Patent Document 9: Japanese Patent Application Publication No. 2007-148356

In an optical scanning device, when the maximum deflection angle on the reflection surface of deflection means is greater than the incident angle of a light beam from light source means, a so-called "feedback light" phenomenon is observed at a certain vibration timing of the mirror (deflection means), the feedback light being a reflection light of a light beam emitted from a light source and reflected on the mirror. This feedback light may cause the increase of noise, thereby impeding stable oscillation and light emission of a laser diode.

In a case where a MEMS vibration mirror is used as the deflection means, a light beam emitted from a light source may be returned (fed back) to the light emitting section of the light source after being reflected on the reflection surface of the reflection means when the vibration mirror is arranged to be moved in a wider range than when the angle between the direction of the light beam from the light source and the direction of the reflection surface of the vibration mirror becomes substantially 90 degrees.

Further, when a light beam emitted from the light emitting section is fed back to another light emitting section, the feedback light may affect the performance of the other light emitting section. Further, when the laser diode(s) is continuously turned ON to be used for detecting the synchronization purpose during other than an image forming period, the temperature of the laser diode(s) may be increased; the light emission efficiency may be reduced; and energy consumption of the laser diode may be increased. Further, unlike polygon mirrors, the MEMS vibration mirror moves back and forth (i.e., the MEMS vibration mirror does not rotate). Accordingly, the light beam is mechanically scanned in both directions along the main scanning direction on an image surface. It is not preferable to apply sinusoidal vibration to the MEMS vibration mirror, because the scanning speed of the light beam near the maximum amplitude is remarkably reduced.

The image forming period is required to be provided while the scanning speed of the light beam is linearly changed as much as possible. In that sense, the image forming period is provided in the middle part between both the maximum amplitudes. The light beam emitted from the laser diode and reflected by the MEMS vibration mirror in a part corresponding to an area other than an image forming area (hereinafter may be referred to as a non-image forming area) may become a so-called ghost light, and a part of which may become the feedback light fed back to the light emitting section of the laser diode, which may cause the power fluctuation. Further, a part of the ghost light which reaches an image carrier such as the photosensitive body may cause to create a ghost image on the image forming surface.

When the maximum deflection angle of the vibration mirror is greater than the maximum incident angle required to scan in the image forming area, namely when the vibration mirror is arranged to move to deflect the light beam beyond the image forming area, it may become possible to prevent the feedback light from reaching the light emitting section of the laser diode by forcibly turning OFF the light beam from the light source when the deflection angle of the vibration mirror is in a range corresponding to the non-image forming area but excluding in a range for detecting the synchronization purpose. More specifically, for example, the LD (laser diode) of the light source is forcibly turned OFF after the light beam passes the PD (photo detector) for the synchronization detection, the PD being installed in the scanning range of the light beam and continued to be turned OFF while the light beam reaches the maximum amplitude and until after the light beam passes the PD again. By turning OFF the LD in the non-image forming area like this, it may become possible to reduce the unnecessary lighting of the LD and better control the temperature increase of the LD and devices near the LD, thereby achieving highly effective light emission and stable lighting of the LD. When a laser diode array (LDA) is used as the light source, it may become possible to reduce the energy consumption and achieve high-power light emission.

When plural light emission points in the light source are provided like the above LDA, a technique may be used in which an amount of light emission is controlled by adjusting a drive current, voltage, pulse width, and the like applied to each of the light emission points so that each of the plural light beams has a desired amount of light emission by performing a light amount control (a.k.a "APC" (Automatic Power Control)) at a timing when the feedback light from each light emission point may otherwise interfere with the stable light emission. Further, in a case where it is difficult to provide such a light emission amount control period as the LD(s) is forcibly turning OFF to perform the APC, the APC may be arranged not to perform the APC while the feedback light is desirably to be turned OFF, or another type of the light emission amount control period may by provided in which a driving current to drive the light emitting section is reduced to a level less than a predetermined level such a case as the amount of light emission is of the LD(s) is reduced to a level less than the threshold level for the detection by the PD. When plural light emission points are provided in the light source, it is necessary to appropriately allocate the timings for the APC among the light emission and the allocation of the light emission amount control periods when each of the light beams is forcibly turned OFF. By providing the light emission amount control period when the light beam is forcibly turned OFF in the non-image forming area, it may become possible to prevent the temperature increase caused by continuous lighting of the LD, maintain stable lighting condition, and reduce the energy consumption.

Even when the LD is unable to be forcibly turned OFF, by appropriately setting the amount of a light beam in accordance with the sensitivity of the LD when the light beam scans on a device for detecting synchronization, it may become possible to provide the light emission amount control period while, for example, the driving current applied to the LD of the light source is reduced to a level equal to or less than a predetermined level, thereby enabling performing an appropriate APC. As described above, by reducing the amount of light emission as much as possible, it may become possible to better control the occurrence of the feedback light phenomenon that a beam light emitted from a light emission point of the light source returns to a light emission point of the same light source, so that stable LD light emission may be maintained.

Based on the ratio and the phase of CW turn ON time for detecting synchronization to PD detection time, it may become possible to set the start and stop counting values determining the light emission amount control period when the light beam is appropriately and forcibly turned OFF. Further, by resetting a pixel counter when the light beam passes the PD and successively monitoring and controlling the amplitude condition of the light beam, it may become possible to appropriately set the light emission amount control period when the light beam is appropriately and forcibly turned OFF and a turn-ON period for one dot for light beam detection means. Further, by employing two-point synchronization, it may become possible to appropriately designate a writing start position in response to the operating condition of the vibration mirror influenced by disturbance. Further, by controlling the positions and the intervals of the pixels, it may become possible to form a high-quality image having less displacement.

SUMMARY OF THE INVENTION

The present invention is made under the circumstances described above and may provide an optical scanning device using a vibration mirror and capable of better controlling the power fluctuation caused by the effect of the feedback light fed back to the laser diode of the light source during the operation of the vibration mirror.

According to an aspect of the present invention, an optical scanning device includes a light source unit having a light emitting section that emits a light beam;

a light source drive unit configured to modulation drive the light source unit;

a deflection unit configured to deflect the light beam emitted from the light source unit and scan in a main scanning area;

a scanning image optical system configured to guide the light beam from the deflection unit onto a target scanning surface; and a light beam detection unit having one or more detection surfaces to detect the light beam from the deflection unit. Further, the optical scanning device is mainly characterized in that a maximum deflection angle of a reflection surface of the deflection unit is greater than an incident angle of the light beam emitted from the light source unit to the reflection surface of the deflection unit, the light source drive unit is configured to control an amount of light emission of the light source unit, and a light emission amount control period in which the light source unit is forcibly turned OFF is set to the light source drive unit while in first and second periods within a non-image forming period, the first period being from a time when the deflection unit deflects to an edge of a scanning angle for scanning the main scanning area to a time when the deflection unit deflects to a maximum deflection angle of the deflection unit, the second period being from a time when the deflection unit deflects to the maximum deflection angle of the deflection unit to a time when the deflection unit deflects to the edge of the scanning angle.

In an optical scanning device having a deflection unit for scanning in the main scanning area and in which the incident angle of the light beam is greater than the maximum amplitude (deflection angle) of the deflection unit, by setting the light emission amount control period in which the light source unit is forcibly turned OFF during in the period in which the light beam emitted from the light source unit is reflected by the reflection surface of the deflection unit and may be fed back to the light source unit again, it may become possible to prevent the occurrence of the feedback light fed back to the light emitting section of the laser diode and provide a stable light emission of the laser diode of the light source.

Further, according to another aspect of the present invention, a light emission amount control period in which a drive current to the light source unit is reduced to a level equal to or less than a predetermined level may be set instead.

In an optical scanning device having a deflection unit for scanning in the main scanning area and in which the incident angle of the light beam is greater than the maximum amplitude of the deflection unit, by setting the light emission amount control period in which the drive current to the light source unit is reduced to the level equal to or less than the predetermined level during in the period in which the light beam emitted from the light source unit is reflected by the reflection surface of the deflection unit and may be fed back to the light source unit again, it may become possible to maintain satisfactory control response, avoid incorrect APC (automatic power control) caused by the feedback light when the feedback light phenomenon occurs, and maintain stable light emission of the laser diode of the light source.

BRIEF DESCRIPTION OF THE DRAWINGS

Other objects, features, and advantages of the present invention will become more apparent from the following description when read in conjunction with the accompanying drawings, in which:

FIG. 6A is a drawing showing a front view of the vibration mirror module;

FIG. 6B is a drawing showing a rear side of the vibration mirror;

FIG. 6C is a cross-sectional view of the vibration mirror;

FIG. 6D is an exploded perspective view of the vibration mirror module;

DETAILED DESCRIPTION OF THE PREFERRED EMBODIMENTS

In the following, an optical scanning device and an image forming device according to an embodiment of the present invention are described with reference to accompanying drawings. According to the embodiment of the present invention, there are provided examples of an optical scanning device and an image forming apparatus using the optical scanning device capable of forcibly turning OFF the light beam emitted from a light emitting section of a light source of the optical scanning device. By configuring in this way, it may becomes possible to avoid an influence of a so-called "feedback light" which is a light beam emitted from a light emitting section of the light source reflected on a reflection surface of the vibration mirror and incident into the light emitting section again when the maximum deflection angle of the vibration mirror of the optical scanning device is greater than the incident angle between the direction of beam light from the light source of the optical scanning device and the normal line direction of the surface of the vibration mirror and when the deflection angle reaches the incident angle.

Figure 1:
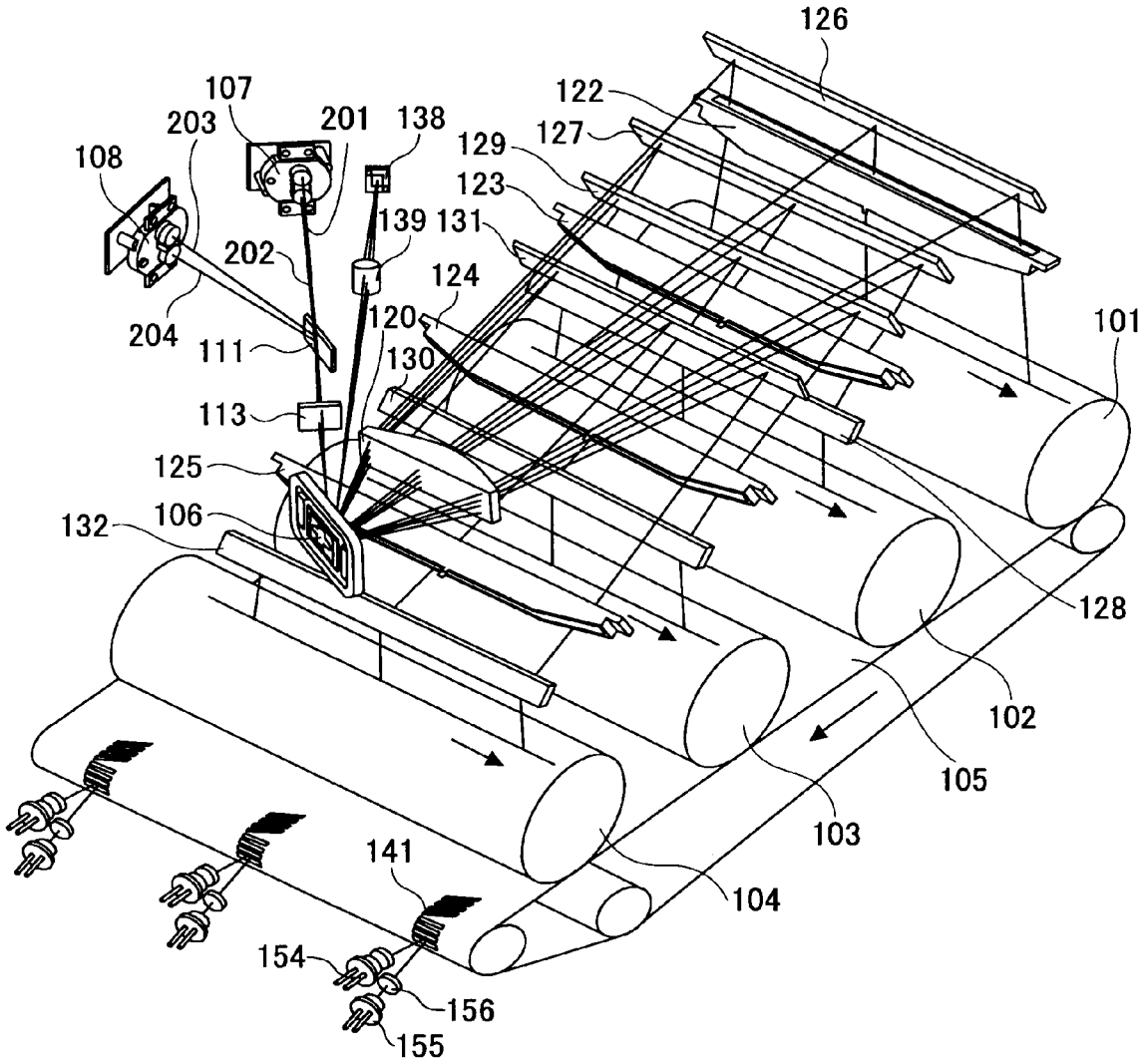
FIG. 1 is a perspective view showing an optical scanning device and a part of an image forming apparatus according to an embodiment of the present invention.
Figure 16:
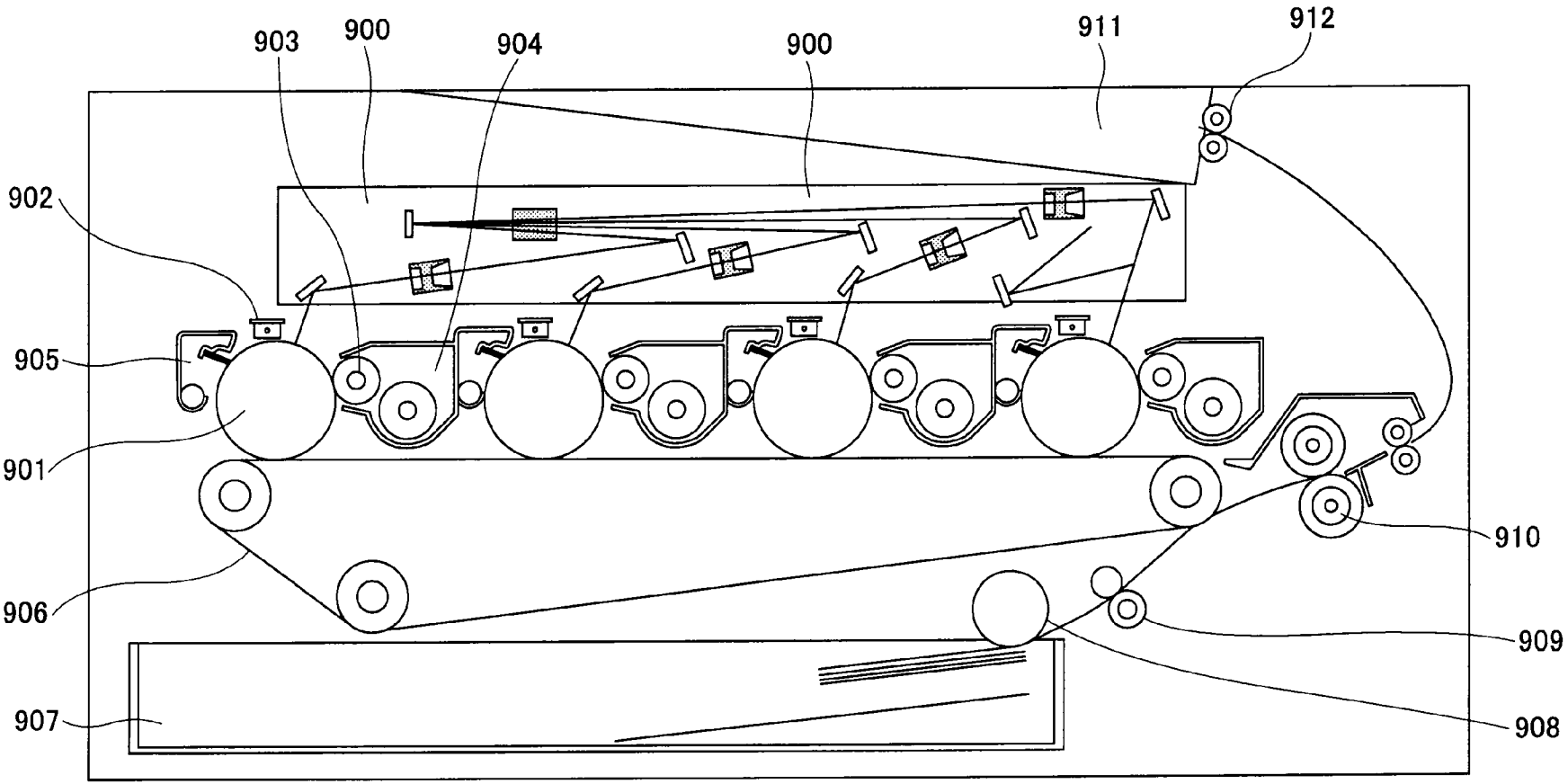
FIG. 16 is a front view schematically showing an image forming apparatus according to an embodiment of the present invention.

FIGS. 1 and 16 show examples of a part of a full-color four-station type image forming apparatus having four latent image forming stations required for forming full color images. In FIG. 16, the reference numeral 900 denotes an optical scanning device. Same as this optical scanning device 900 in FIG. 16, the optical scanning device shown in FIG. 1 includes a single vibration mirror 106 serving as an optical deflector. This optical scanning device employs a one-side scanning method in which the vibration mirror 106 includes a reflection surface on its one side and plural light beams corresponding to the stations are scanned by using the reflection surface of the vibration mirror 106. The optical scanning device (900 in FIG. 16) in which each light beam scans on the corresponding surfaces of photosensitive body drums (image carrier bodies) (101, 102, 103, and 104 in FIG. 1) is integrally incorporated into an image forming apparatus. The four photosensitive body drums 101, 102, 103, and 104 are arranged on a straight line at regular intervals along the traveling direction of an intermediate transfer belt 105. In the optical scanning device (900), light beams emitted from light source units (light source means) 107 and 108 corresponding to the four photosensitive body drums 101, 102, 103, and 104 are deflected by the vibration mirror 106 and scanned to the photosensitive body drums 101, 102, 103, and 104 through an image scanning optical system and appropriate mirrors, so that (latent) images corresponding to the colors are simultaneously formed on the surfaces of the photosensitive body drums 101, 102, 103, and 104.

In the optical scanning device, the light beams emitted from the light source units 107 and 108 are obliquely incident to the vibration mirror 106 with different incident angles. By doing in this way, the light beams emitted from the light source units 107 and 108 are collectively deflected and scanned. The light source units 107 and 108 are disposed in the sub-scanning direction (vertical direction). Namely, the light source unit 107 is disposed above the light source unit 108. Further, the light source units 107 and 108 are adjusted so that the angle between the light beams emitted from each of the light source units 107 and 108 becomes a predetermined angle such as 2.5 degrees and integrally supported so that the light beams emitted from the light source units 107 and 108 are crossed with each other on the reflection surface 441 (see FIG. 6) of the vibration mirror described below. In this embodiment of the present invention, the light source unit 107 is inclined so that the angle between an optical axis (based on the median line of the light beams emitted from this light source unit) and a main scanning plane (a horizontal plane) is 1.25 degrees. Accordingly, the light beam emitted from the lower light emitting section of the light source unit 107 travels horizontally (parallel to the main scanning plane) and the light beam emitted from the upper light emitting section of the light source units 107 travels downward at an angle of 2.5 degrees to the main scanning plane. On the other hand, the light source unit 108 is inclined so that the angle between the optical axis and a main scanning plane (a horizontal plane) is 1.25 degrees. Accordingly, the light beam emitted from the upper light emitting section of the light source units 108 travels horizontally and the light beam emitted from the lower light emitting section of the light source units 108 travels upward at an angle of 2.5 degrees to the main scanning plane. Further, the light source units 107 and 108 are disposed in different positions in the sub-scanning direction (vertical direction) so that the optical axes of the light source units 107 and 108 extend in the sub-scanning plane (vertical plane) and crossed with each other on the reflection surface 441 of the vibration mirror.

As described above, the light source unit 108 is disposed under the light source unit 107. The travel paths of the light beams emitted from the light source units 107 and 108 are bent by an incident mirror 111 so that the light beams 201, 202, 203, and 204 are vertically arranged in this order from top to bottom and travels in the same vertical plane. The light beams 201, 202, 203, and 204 are incident into a cylinder lens 113 with different heights. Further, the light beams 201, 202, 203, and 204 are incident to the vibration mirror in a manner so that the angle on the main scanning plane between the direction of the light beams 201, 202, 203, and 204 and the normal line of the vibration mirror 106 is 22.5 degrees ($=\alpha/2+\theta d$) and the light beams 201, 202, 203, and 204 cross with each other in the sub-scanning direction (vertical direction) on the reflection surface of the vibration mirror 106. The light beams 201, 202, 203, and 204 pass the cylinder lens 113 to be converged in the sub-scanning direction (vertical direction) in the vicinity of the reflection surface of the vibration mirror 106. After being deflected by the vibration mirror 106, the light beams 201, 202, 203, and 204 diverge from each other and are incident into an fθ lens (hereinafter may be referred to as a "scanning lens") 120. The fθ lens 120 is commonly used in each station and does not converge the light beams in the sub-scanning direction.

The light beams emitted from the light source units and passed through the fθ lens 120 are scanned to the photosensitive body drums to form images in the manner described below.

The light beam 204 emitted from the lower side of the light source unit 108 is reflected by a fold mirror 126, passes through a toroidal lens 122, is imaged as a spot on the photosensitive body drum 101, and is scanned on the photosensitive body drum 101 in the direction parallel to the rotation axis of the photosensitive body drum 101 to form a latent image on the photosensitive body drum 101 based on yellow-color image information as a first image forming station.

The light beam 203 emitted from the upper side of the light source unit 108 is reflected by a fold mirror 127, passes through a toroidal lens 123, is reflected by a fold mirror 128, is imaged as a spot on the photosensitive body drum 102, and is scanned on the photosensitive body drum 102 in the direction parallel to the rotation axis of the photosensitive body drum 102 to form a latent image on the photosensitive body drum 102 based on magenta-color image information as a second image forming station.

The light beam 202 emitted from the lower side of the light source unit 107 is reflected by a fold mirror 129, passes through a toroidal lens 124, is reflected by a fold mirror 130, is imaged as a spot on the photosensitive body drum 103, and is scanned on the photosensitive body drum 103 in the direction parallel to the rotation axis of the photosensitive body drum 103 to form a latent image on the photosensitive body drum 103 based on cyan-color image information as a third image forming station.

The light beam 201 emitted from the upper side of the light source unit 107 is reflected by a fold mirror 131, passes through a toroidal lens 125, is reflected by a fold mirror 132, is imaged as a spot on the photosensitive body drum 104, and is scanned on the photosensitive body drum 104 in the direction parallel to the rotation axis of the photosensitive body drum 104 to form a latent image on the photosensitive body drum 104 based on black-color image information as a fourth image forming station.

Those component parts are integrally supported by a single housing described below.

The optical scanning device further includes a synchronization detection sensor (hereinafter may be referred to as a synchronization detection PD) 138 for determining a writing timing of the light beam onto each of the photosensitive body drums in the optical scanning process. The synchronization detection sensor 138 is arranged to detect a light beam when the light beam deflected by the vibration mirror 106, passing by the scanning lens 120, and converged by an imaging lens 139 is incident to the synchronization detection sensor 138. Further, a synchronization detection signal with respect to each station is generated based on the detection signal from the synchronization detection sensor 138.

In the vicinity of a discharge roller section of the intermediate transfer belt 105 (left-end side of FIG. 1), there is provided a superimposing accuracy detection means for detecting the accuracy of superimposing color images formed and superimposed in each station. The superimposing accuracy detection means detects the difference between the main-scanning resist and the sub-scanning resist of one station as a reference station and those of the stations other than the reference station by reading detection patterns of toner images formed on the intermediate transfer belt 105, and periodically performs a correction process based on the detected results. In this embodiment of the present invention, the superimposing accuracy detection means includes an LED device 154 for lighting, a photo sensor 155 for receiving a reflected light, and a condensing lens 156. The superimposing accuracy detection means are disposed at three positions which are the left-end, the center, and the right-end sections of the image forming area of the optical scanning device. The superimposing accuracy detection means detects the time difference between the above detection pattern and black color which is a reference color as the intermediate transfer belt 105 travels.

Figure 2:
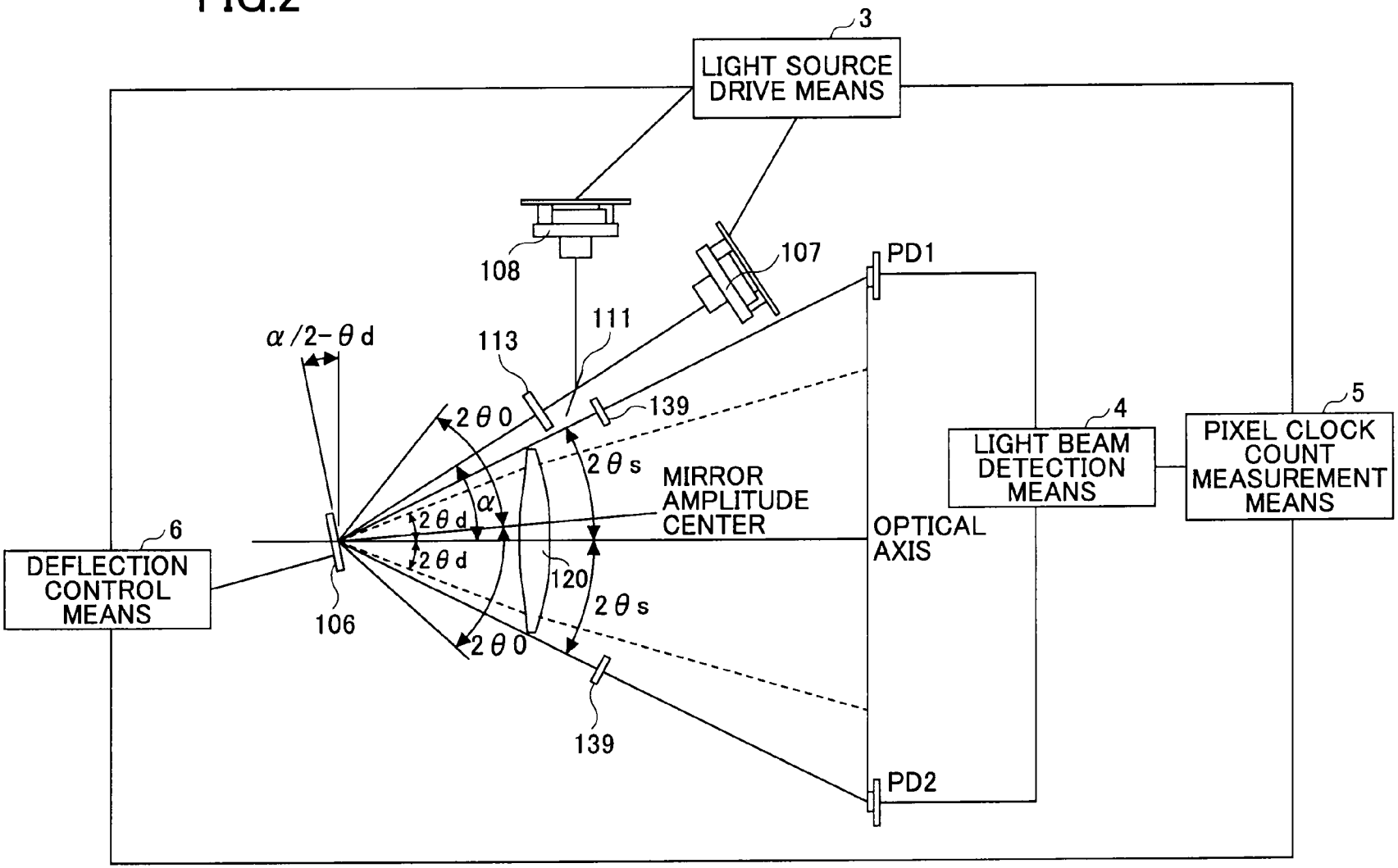
FIG. 2 is a top view of the optical scanning device and a block diagram schematically showing a control system of the optical scanning device.

According to the embodiment of the present invention, the light emission amount control period in which the light beam is forcibly turned OFF is provided so as to control the power fluctuation caused by the light beam incident to the light emitting section of the light source means as the feedback light after being reflected on the vibration mirror when the maximum deflection angle on the reflection surface of the vibration mirror (deflection means) is greater than the incident angle of a light beam traveling from light source means to the reflection surface of the vibration mirror. FIG. 2 shows an exemplary configuration of the optical scanning device having a power source drive means controlling the amount of light emission of the light source means by setting the light emission amount control period. As shown in FIG. 2, the optical scanning device includes a synchronization detection sensor PD1 (corresponding to the synchronization detection sensor 138 in FIG. 1) as synchronization detection means for detecting a light beam deflected by the vibration of the vibration mirror 106 and scanned on a target scanning surface; the other synchronization detection sensor PD2 disposed on the other side of the optical axis; the light source drive means 3 for generating pulsed laser emission from the light emitting sections of the light source units 107 and 108; light beam detection means 4 detecting a timing when the light beam passes the detection surfaces of the synchronization detection sensors PD1 and PD2; and a pixel clock count measurement means 5 counting a pixel clock between the synchronization detection sensors PD1 and PD2 based on the detection signal from the light beam detection means 4.

Next, an operation procedure of the optical scanning device is described that includes the light source drive means 3 that controls the amount of light emission of the laser diode (LD) as light source for optical scanning and forcibly turns OFF the light beam in accordance with predetermined timings. To simplify the description, a case is described where the pulsed laser is emitted from only the light source unit 107. A light beam emitted from the light source unit 107 that is pulse driven by the light source drive means 3 is deflected and scanned by the vibration mirror 106. When the light beam passes on the synchronization detection sensor PD1 of the synchronization detection means, a value of the pixel counter in the light source drive means 3 is reset to zero (0). According to an embodiment of the present invention, the laser diode of the light source may be pulse driven by appropriately designating the writing start position, the writing stop position, the dot pitch, and the like by referring, as origin points, to the detection signal of the synchronization detection means disposed on both sides in the main scanning direction on the target scanning surface, thereby enabling forming a dot at a desirable position with desirable pitch in the image forming area.

Based on the detection signal detecting the light beam by the synchronization detection means, the amplitude, the phase, the cycle, the offset and the like of the vibration mirror 106 are calculated, and the amplitude of the vibration mirror 106 is controlled by deflection control means. In response to the operating condition of the vibration mirror 106, the light source drive means 3 drive controls the light source section based on the writing data in the image forming area to pulse drive the laser diode. Further, a forcible lighting period is determined in response to the result of the synchronization detection, and the light beam is forcibly turned OFF when the deflection angle of the vibration mirror 106 is close to the incident angle of the light beam to avoid the occurrence of the power fluctuation of the laser diode caused by the phenomenon that the light beam is reflected by the reflection surface of the vibration mirror 106 and is incident as the feedback light into light emitting section of the light source unit 107. In a non-image forming area (an area other than the image forming area) excluding a synchronization detection area (for synchronization detection), the light emission amount control period in which the light beam is forcibly turned OFF or the light emission amount control period in which the driving current is reduced to a level equal to or less than a predetermined level is provided. By doing in this way, it may become possible to control the occurrence of the feedback light fed back to the light emitting section of the light source unit after being reflected by the reflection surface of the vibration mirror 106 and the occurrence of the other ghost light. Further, it may become possible to avoid the power fluctuation caused by the feedback light to the laser diode, keep the light emission efficiency at a high level, and maintain stable pulsed emission.

FIG. 2 is a block diagram showing an exemplary configuration of a control system of the optical scanning device in which the light emission amount control period is provided and a light beam may be forcibly turned OFF to avoid the feedback light phenomenon. The synchronization detection sensors PD1 and PD2 are arranged to detect a light beam when the light beam deflected by the vibration mirror 106, passing by the scanning lens 120, converged by an imaging lens 139, and is incident to the synchronization detection sensors PD1 and PD2. Further, a synchronization detection signal with respect to each station is generated based on the detection signal from the synchronization detection sensors PD1 and PD2.

Conventionally, the relationship between the incident angle "α" to the surface of the vibration mirror and the deflection angle (amplitude) "θ0" of the vibration mirror is given by:

$$\alpha > 2\theta 0$$

and the maximum deflection angle is given by:

$$2\theta max = \alpha + 2\theta 0$$

On the other hand, according to an embodiment of the present invention, an effective scanning ratio (θd/θ0) is reduced to a value equal to or less than a predetermined value which is, for example, 0.6. Therefore, when "θd" denotes an effective deflection angle scanning on the photoresist body and "θs" denotes a deflection angle when synchronization is detected, the incident angle α when the light beam from the light source means is incident to the reflection surface of the vibration mirror is set so that the following relationships are satisfied:

$$\theta 0 \geqq \alpha/2 > \theta d$$

$$\theta 0 \geqq \theta s > \theta d$$

More specifically, in this embodiment, the following values are used.

θ0=25 degrees, θd=15 degrees, α=45 degrees, θs=18 degrees

Further, the synchronization detection sensors may be disposed so that the relationship θs>α/2 is satisfied. In FIG. 2, a case is shown where the amplitude center does not correspond to the optical axis of the scanning lens, more specifically the amplitude center is shifted to the light source side. However, in this embodiment of the present invention, for the explanation purposes, a case is described where the amplitude center corresponds to the optical axis of the scanning lens and each of the surface figures of the scanning lens through the toroidal lens is a curved shape and symmetric along the main scanning direction.

As described above, the vibration mirror moves back and forth. Because of the vibration, the reflection surface of the vibration mirror may be deformed like a wave. The deformation amount δ is maximized when the amplitude is θ0 and is likely to be proportionally increased when the deflection angle changes from zero (0) to θ0. Namely, the deflection angle θd scanning in a scanning area is determined by the field angle of the scanning lens. Therefore, the smaller the ratio of the deflection angle θd scanning in a scanning area to the amplitude θ0 which is effective scanning ratio (θd/θ0) is, the less affected by the deformation of the vibration mirror.

However, there is a conflict. Namely, to increase the amplitude θ0, it is necessary to reduce the mass of the mirror substrate. On the other hand, when the thickness of the mirror substrate is reduced, the deformation amount δ increases. In this embodiment, the effective scanning ratio (θd/θ0) is set in a range of the deflection angle where the angular velocity of the vibration mirror 106 becomes relatively constant, which is equal to or less than 60%. By setting in this way, the deformation amount δ is controlled.

On the other hand, when the incident angle α is increased, the light beam is likely to be more affected by the dynamic surface deformation of the vibration mirror. More specifically, as shown in FIG. 2, a case is described where the maximum amplitude 2θ0=50 degrees, the incident angle α=45 degrees, the scanning angle 2·θd=30 degrees, and the synchronization detection angle 2·θs=36 degrees. In this case, the maximum deflection angle of the vibration mirror 106 is greater than the incident angle α, therefore the feedback light phenomenon occurs that the light beam is reflected on the reflection surface of the vibration mirror 106 and fed back to the light source. Therefore, at the timing when the light beam emitted from the light source is returned from the reflection surface to the light source again, the emission of the laser diode becomes unstable due to the feedback light (feedback light phenomenon). To avoid this feedback phenomenon, it is necessary to temporarily turn OFF the light beam in a certain period when otherwise the feedback light occurs or stop a process, such as the APC, of adjusting the amount of light emission. The timing when the feedback phenomenon occurs may vary depending on the vibrating condition of the vibration mirror 106. Therefore, it is necessary to appropriately adjust the start position and the duration of the light emission amount control period.

To that end, as shown in FIG. 2, the synchronization detection sensors PD1 and PD2 serving as light beam detection means are disposed one on each end of an image surface and the timings when the light beam passes on the synchronization detection sensors PD1 and PD2 are monitored. By doing in this way, it may become possible to detect the vibration conditions which may be the phase, the cycle, the shift amount of the deflection center, the magnification error and the like. The light source is pulse driven by the light source drive means 3 so that the start position, the stop position, and the duration of the light emission amount control period are appropriately determined by counting the pixel clock of the light beam between the synchronization detection sensors PD1 and PD2 in the same manner as determining the start position of the synchronization detection process. The detected vibration conditions of the vibration mirror are sent to the deflection control means 6, and the vibration mirror 106 is controlled so as to desirably vibrate by using control parameters such as a drive voltage and a vibration frequency.

Figure 3:
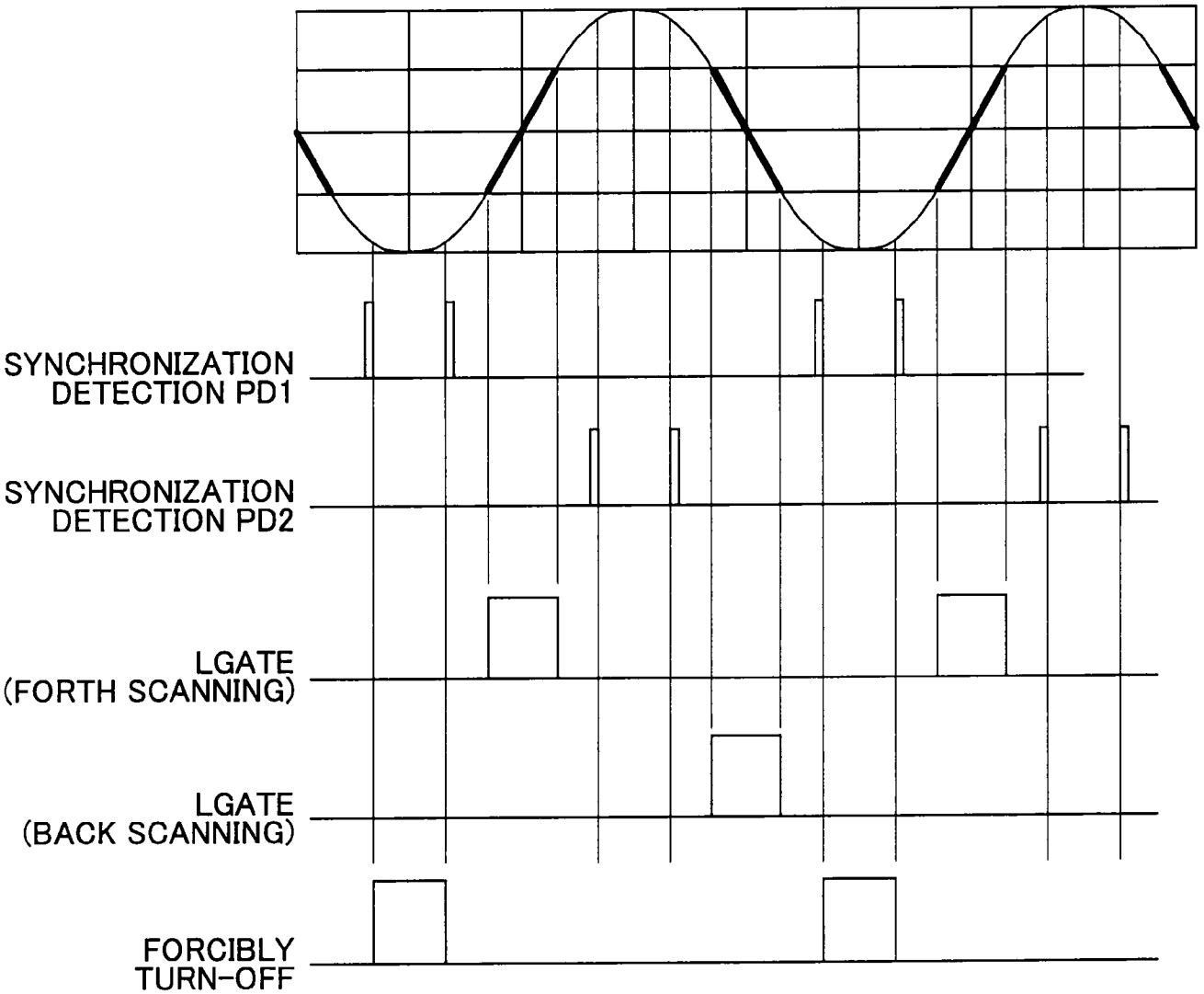
FIG. 3 is a graph showing a vibration operation of a vibration mirror in the embodiment of the present invention and a timing chart indicating a synchronization detection and turn-ON timings of a light source.

FIG. 3 shows a graph showing a vibration operation of the vibration mirror 106 when the synchronization detection sensors PD1 and PD2 are disposed one on each end of an image forming area. Further, FIG. 3 shows a time chart indicating the turn-ON timings of the LD (laser diode). In the graph, the vertical axis represents the deflection angle, and the horizontal axis represents time. The sine wave shown in the uppermost part of FIG. 3 indicates the vibration of the vibration mirror 106. The bold line part (±2θd) of the sine wave indicates the image forming areas, and in the image forming areas, a "forward scanning" and a "back scanning" are performed. The synchronization detection sensors PD1 and PD2 are disposed in the non-image forming area (±2θs) to monitor the scan of the light beam. The light source means is disposed on the same side as the synchronization detection sensor PD1 is disposed. Therefore, feedback light occurs when the light beam scans on the same side as the synchronization detection sensor PD1 is disposed. The incident angle α of the light beam from the light source means to the reflection surface of the vibration mirror correspond to an angle in a range between θs and θ0 of the deflection angle of the vibration mirror (an angle in a range between 2θs and 2θ0 of the scanning angle.) Therefore, while in the range, the light emission amount control period in which the light beam is forcibly turned OFF is provided. By doing in this way, it may become possible to prevent the emission of the laser diode of the light source means from being unstable due to the feedback phenomenon.

Figure 4B:
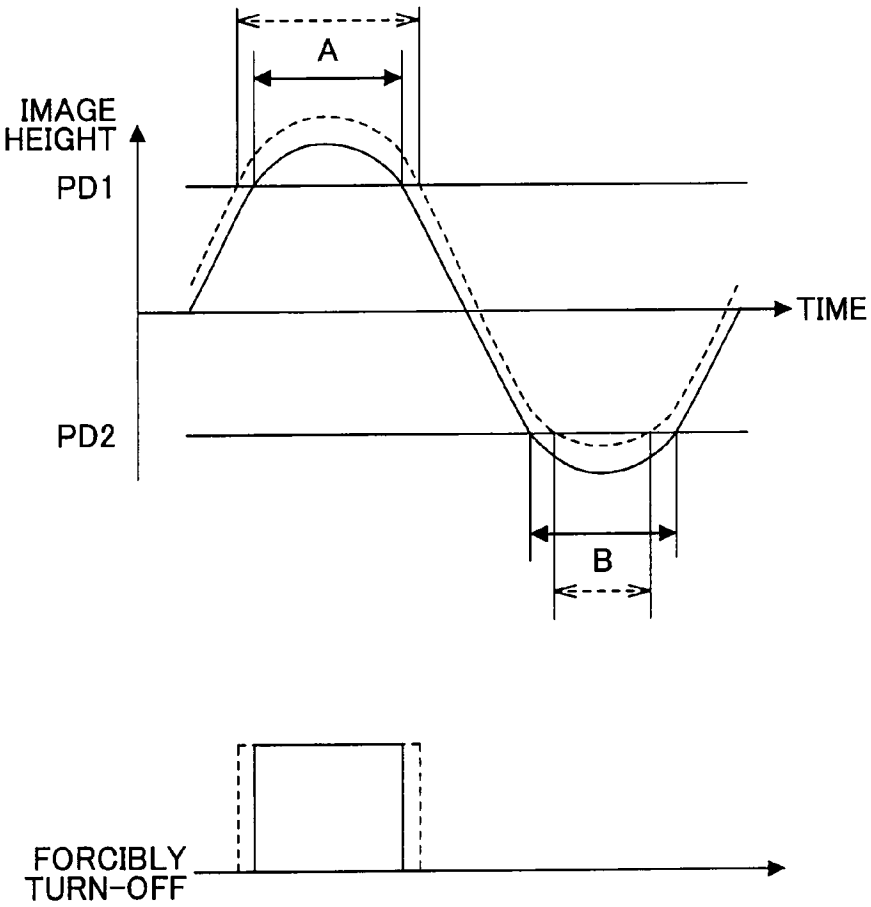
FIGS. 4A and 4B are waveform charts showing the change of the vibration waveform when a vibration condition of the vibration mirror is changed in the embodiment of the present invention.
Figure 4A:
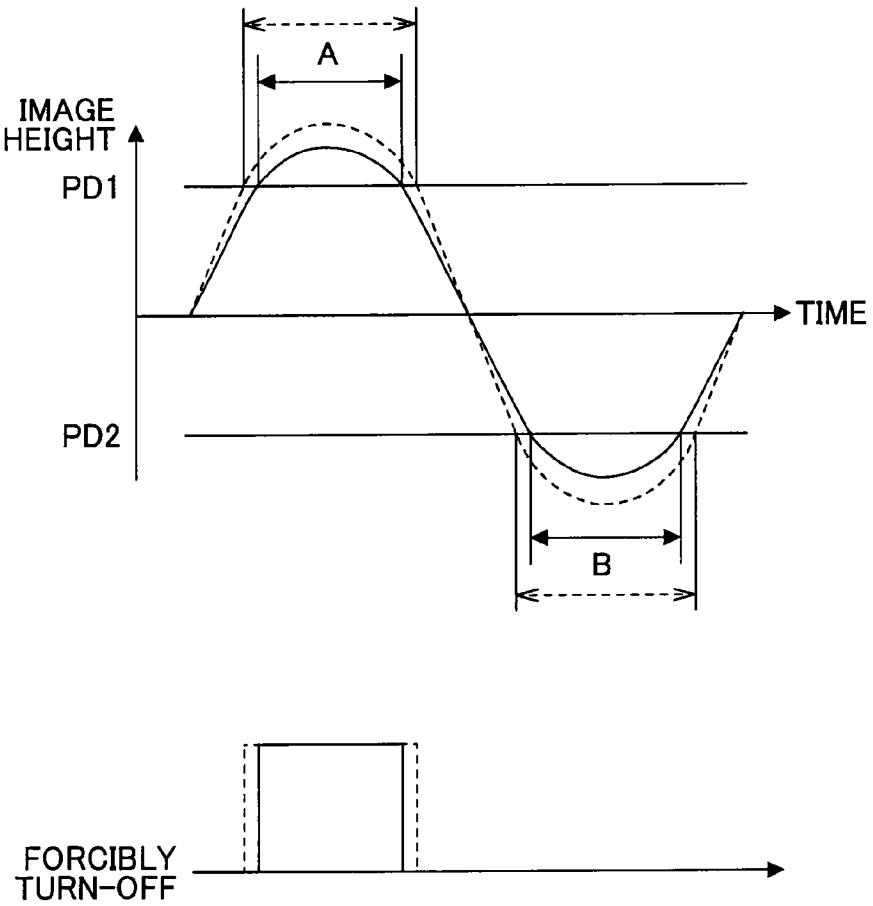

FIGS. 4A and 4B are graphs showing cases where the vibration condition of the vibration mirror is changed. More specifically, FIG. 4A shows a case where the amplitude of the vibration mirror (in a dotted line) becomes greater than that of the vibration monitor (in a solid line). In the figures, the period "A" is disposed on one side of the vibration, and the period "B" is disposed on the other side of the vibration. In FIG. 4A, the periods "A" and "B" between when the scanned light beam passes one of synchronization detection sensor positions disposed outside of the image forming area and when the scanned light beam passes the same synchronization detection sensor position after passing the maximum image height change in substantially the same manner that the periods "A" and "B" change in proportion to the change of the amplitude of the vibration mirror. In this case, it may become possible to appropriately determine the light emission amount control period in which the light beam is forcibly turned OFF in response to the current amplitude conditions of the vibration mirror by previously storing the relations between the amplitude change of the vibration mirror and the positions where the synchronization detection sensors are disposed in a database table and referring to the database table.

More specifically, in a case where the light source means is disposed on the same side as the period "A" is provided, when the period "A" in the solid line is compared with the period "A" in the dotted line, the period "A" in the dotted line from when the light beam passes the synchronization detection sensor to when the light beam passes the same synchronization detection sensor is longer than the period "A" in the solid line, and the light beam reaches the incident angle $\alpha$ earlier in the period "A" in the dotted line than in the period "A" in the solid line. Therefore, when the vibration is changed from the solid line to the dotted line in FIG. 4A, it is necessary to start the light emission amount control period in which the light beam is forcibly turned OFF earlier and stop the light emission amount control period later.

FIG. 4B shows a case where the amplitude center of the image position on the vibration mirror is shifted to the + image height side. In this case, on the + image height side where the period "A" is provided, the period "A" in the solid line between from when the light beam passes the synchronization detection sensor and to when the light beam passes the same synchronization detection sensor after passing the maximum image height position becomes longer as shown in the period "A" in the dotted line. On the other side where the period "B" is provided, the period "B" in the solid line between from when the light beam passes the synchronization detection sensor and to when the light beam passes the same synchronization detection sensor after passing the maximum image height position becomes shorter as shown in the period "B" in the dotted line. In such a case as the amplitude center is shifted to one side, by storing in advance the relations between the amplitude change of the vibration mirror and the positions where the synchronization detection sensors are disposed in a database table and referring to the database table, it may become possible to appropriately determine the light emission amount control period in which the light beam is forcibly turned OFF in response to the current amplitude conditions of the vibration mirror.

Figure 5A:
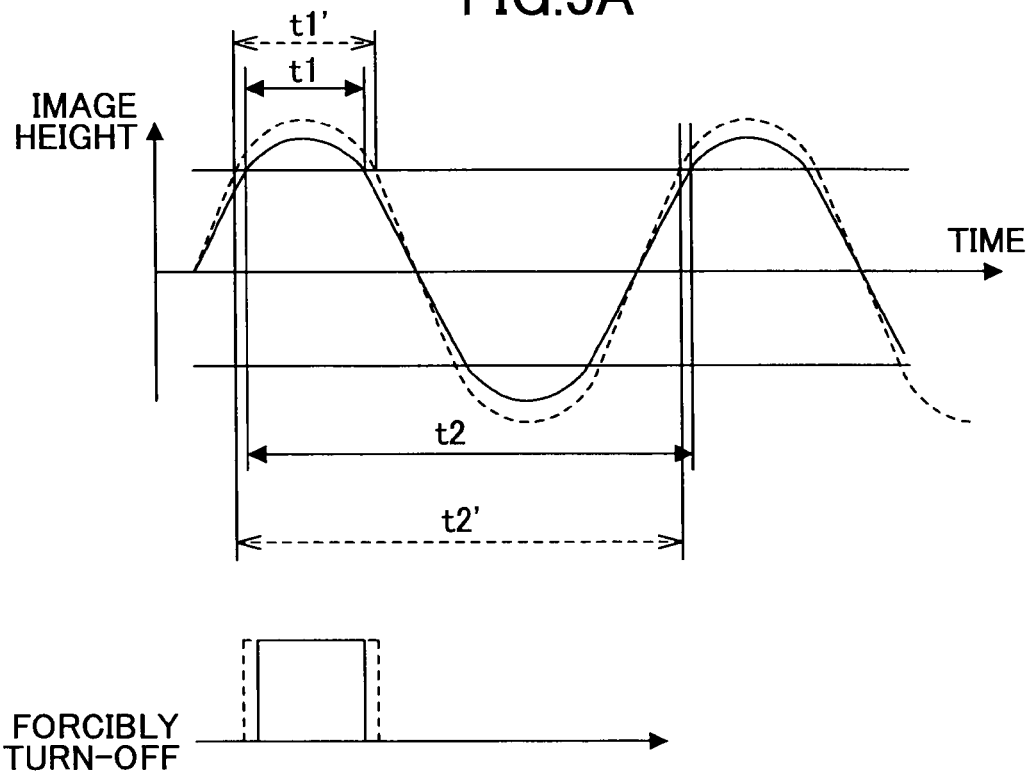
FIG. 5A through 5C are waveform charts showing a time period from when a light beam deflected and scanned passes the position of a synchronization detection sensor to when the light beam is returned to the position of a synchronization detection sensor after passing of a synchronization detection sensor after passing the point of the maximum deflection amplitude and a time period from when a light beam deflected and scanned passes the position of a synchronization detection sensor in a direction to when the light beam is returned to the position of a synchronization detection sensor in the same direction again.
Figure 5B:
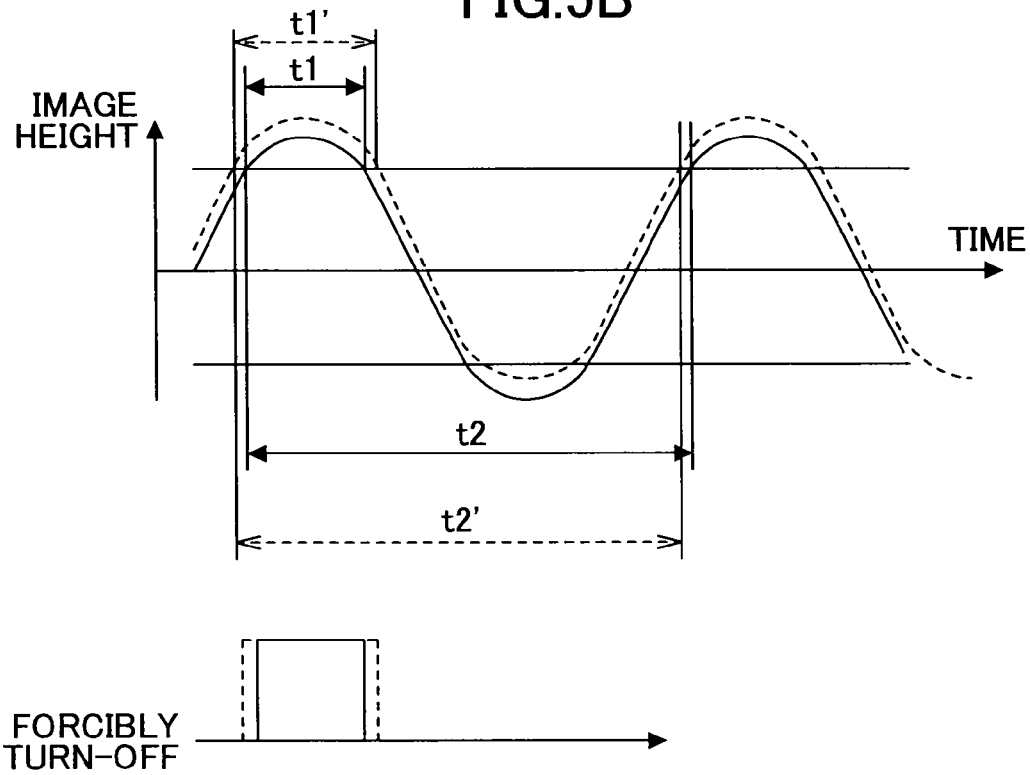
Figure 5C:
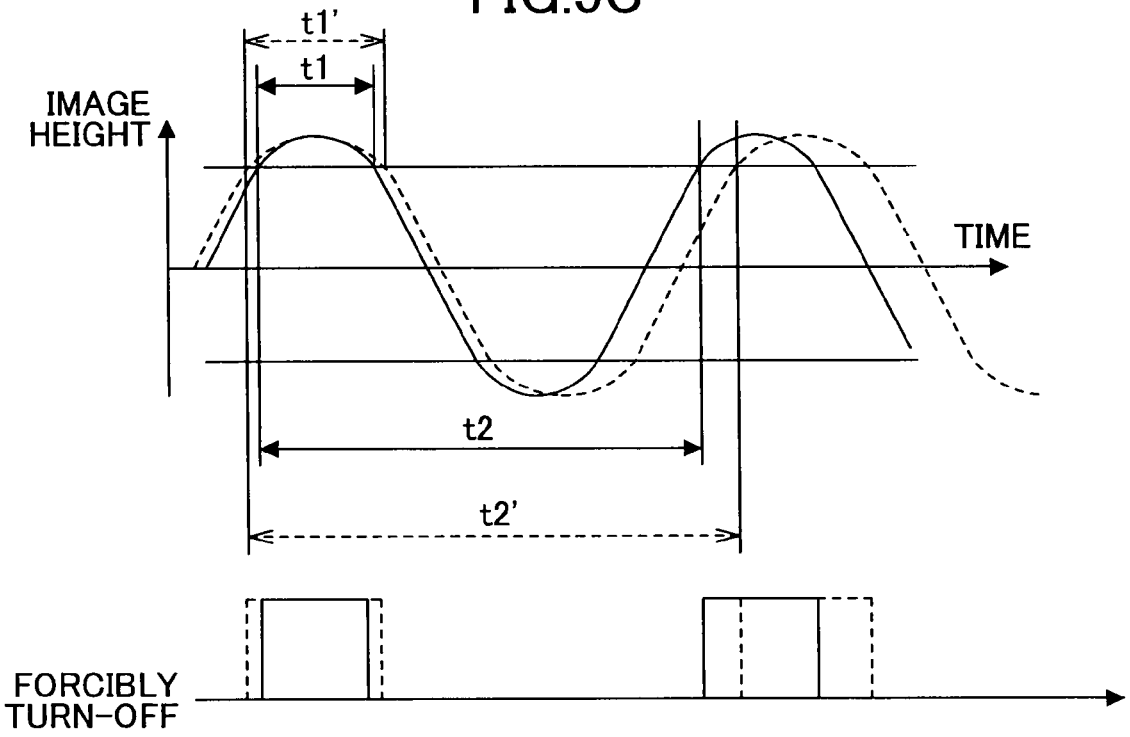

FIGS. 5A through 5C shows the relationship between a period "t1(t1')" and a period "t2(t2')", where the period "t1(t1')" being between from when the light beam passes the synchronization detection sensor and to when the light beam passes the same synchronization detection sensor after passing the maximum image height position, and the period "t2(t2')" being between from when the light beam passes the synchronization detection sensor in one direction and to when the light beam passes the same synchronization detection sensor in the same direction (corresponding to one cycle).

In an example shown in FIG. 5A, the maximum deflection angle in the period "t1'" in the dotted line is greater than that in the period "t1" in the solid line, therefore the period "t1'" in the dotted line becomes longer than the period "t1" in the solid line. However, the cycle of the vibration mirror is not changed, the period "t2" in the solid line when the amplitude is smaller is the same as the period "t2'" in the dotted line when the amplitude is larger. Therefore, by measuring the periods "t1" and "t2", it may become possible to measure the fluctuation of the deflection angle of the vibration mirror. Further, based on the measurement result, it may become possible to cause the light source drive means 3 (see FIG. 2) to drive and modulate the light source so as to appropriately change the setting of the light emission amount control period in which the light beam is forcibly turned OFF.

FIG. 5B shows a case where the amplitude center of the image position on the vibration mirror is shifted to the + image height side. In this case, same as the case in FIG. 5A, the cycle of the vibration mirror is not changed. Therefore, the period "t2'" is the same as the period "t2". However, the period "t1'" becomes longer than the period "t1" due to the shift to the + image height side. Then, a case is described where there is provided the synchronization detection sensor on only one side (not on both sides). In this case, on the opposite side where no synchronization detection sensor is provided, it is not possible to determine whether the waveform in the solid line has a larger amplitude than the waveform in the dotted line. Therefore, in this case, the optical scanning device is unable to distinguish the case where the amplitude center of the vibration mirror is shifted from the case where the amplitude is increased. In order to monitor whether the amplitude of the vibration mirror is changed or whether the amplitude center is shifted, it is necessary for the optical scanning device to have the synchronization detection sensors each on both end sides which are outside of the image forming area. By having this configuration, it may become possible to calculate light emission amount control period based on the scanning conditions of the vibration mirror obtained by the synchronization detection sensors and appropriately set the timings to forcibly turn OFF the light beam.

FIG. 5C shows a case where the deflection cycle of the vibration mirror is changed (increased). In this case, the period "t1'" between from when the light beam passes the synchronization detection sensor and to when the light beam passes the same synchronization detection sensor after passing the maximum image height position becomes longer than the period "t1", and the period "t2'" between from when the light beam passes the synchronization detection sensor in a direction and to when the light beam passes the same synchronization detection sensor in the same direction becomes longer than the period "t2" due to the change (increase) of the deflection cycle of the vibration mirror. Based on the measurement results, it may become possible to cause the light source drive means 3 to perform pulse modulation drive of the light source so as to increase the length of the cycle of the light emission amount control period in which the light beam is forcibly turned OFF.

Figure 6A:
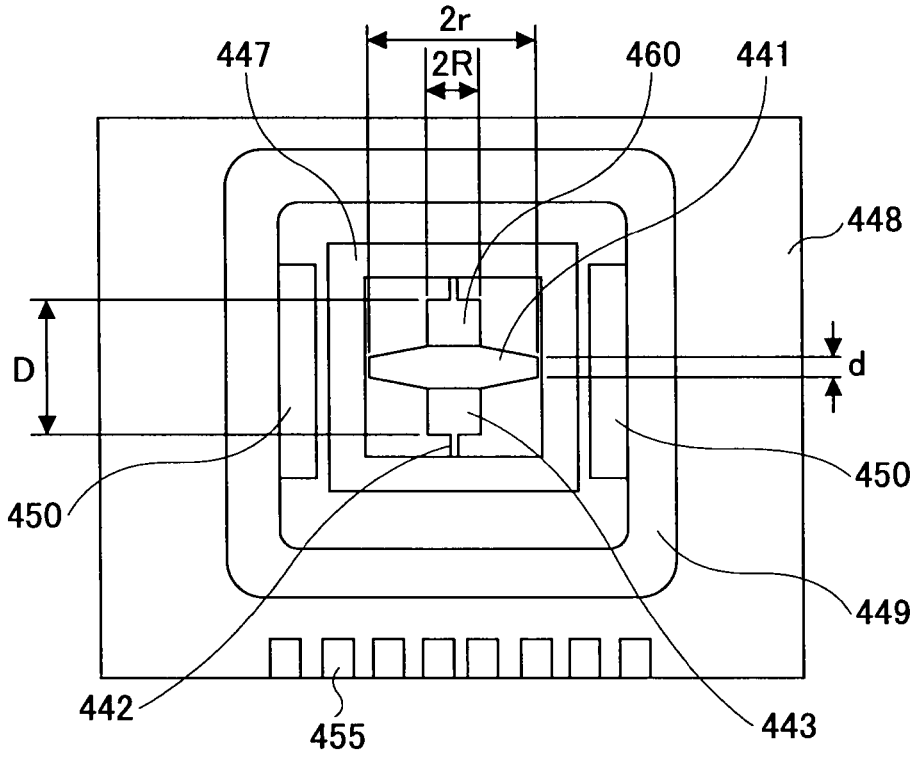
FIG. 6A through 6D are drawings showing elements of a vibration mirror module.
Figure 6B:
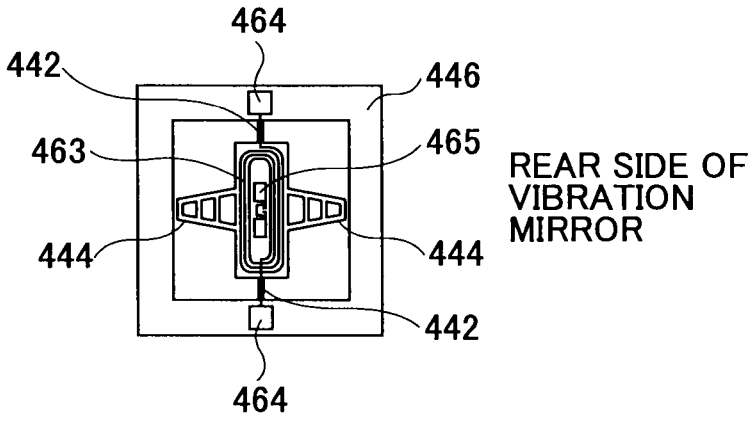
Figure 6C:
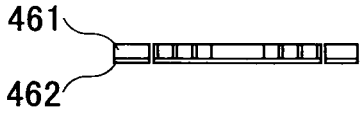

An exemplary configuration of the vibration mirror to be used in the optical scanning device described above according to an embodiment of the present invention is described with reference to FIGS. 6A through 6D. FIGS. 6A through 6D collectively show the vibration mirror and a module for driving (deflecting) the vibration mirror. In this exemplary configuration of the vibration mirror module, an electromagnetic driving method is employed as the method of generating rotary torque to drive the vibration mirror. As shown in FIGS. 6A and 6B, each of upper and lower center portions of a vibration mirror surface 441 having a mirror surface on its front surface is axially supported by a torsion beam 442. The vibration mirror surface 441 is formed by penetrating its exterior of from a single Si substrate by an etching process and mounted on a mounting board 440. The mounting board 440 constitutes a vibration mirror substrate 448 having the vibration mirror surface 441 integrally incorporated therein as a unit.

In the example of FIGS. 6A through 6D, the vibration mirror substrate 448 is mounted on one side of the vibration mirror module as an "one-side scanning method". However, two vibration mirror substrates 448 may be integrally mounted each on both sides of the vibration mirror modules as a "double-side scanning method".

Figure 6D:
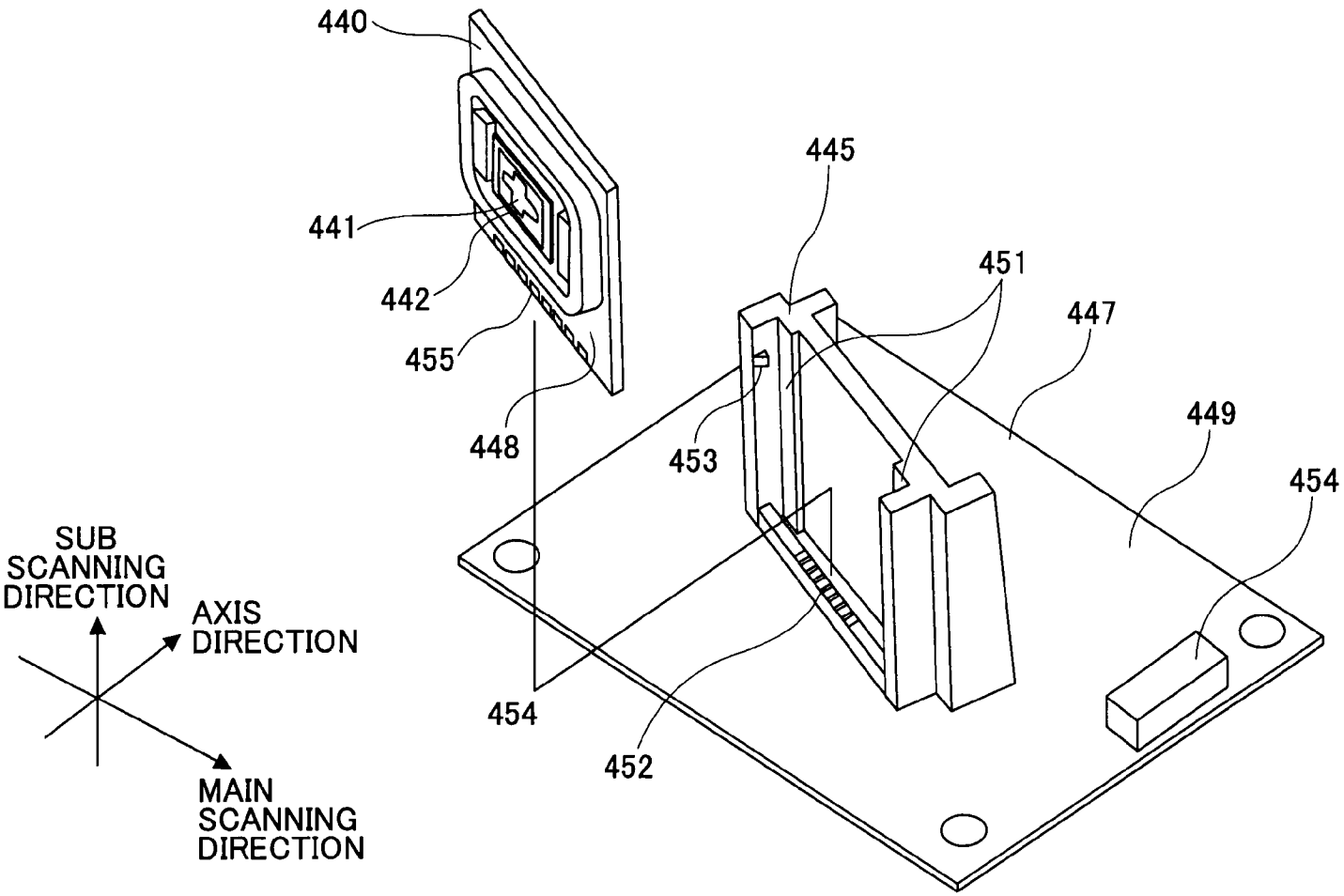

As shown in FIG. 6D, the mounting board 440 is fit and fixed into a frame-shaped supporting member 445. The supporting member 445 is formed of resin and is positioned at a predetermined position on a circuit substrate 449 (see FIG. 6D). The supporting member 445 includes a position determination section 451 determining the position of the torsion beam 442 to be orthogonal to the main scanning plane (horizontal plane) and the angle between the direction of the vibration mirror surface 441 and the main scanning direction (see FIG. 6D) to be a predetermined angle such as 22.5 degrees in this embodiment. The supporting member 445 further includes an edge connector section 452 to be electrically connected to a wiring terminal 455 formed on one (lower) side of the mounting board 440 when the mounting board 440 is fit and fixed into a frame-shaped supporting member 445. The edge connector section 452 may be a plurality of metal terminals integrally arranged onto the supporting member 445.

One side of the vibration mirror substrate 448 is inserted into the edge connector section 452. The vibration mirror substrate 448 is fixed inside a fixing hook 453. Further, both side surfaces of the rear side of the vibration mirror substrate 448 are supported by and along the position determination section 451. By configuring in this way, the vibration mirror substrate 448 is securely in electrically contact with the edge connector section 452.

On the circuit substrate 449, there are mounted a control IC constituting a drive circuit to drive the vibration mirror, a crystal oscillator and the like. Those mounted parts inputs and outputs power and control signals through a connector 454 on the circuit substrate 449. The vibration mirror includes a moving section on which the vibration mirror surface 441 is formed and functioning as a vibrator, the torsion beam 442 axially supporting the moving section and forming a rotating axis, and a frame constituting a supporting section. The vibration mirror may be formed by removing outside portions by etching from a Si substrate.

According to this embodiment of the present invention, the vibration mirror is formed of a wafer called an SOI substrate wafer in which an oxide film is sandwiched by two substrates having thicknesses of 60 μm and 140 μm. First, plasma etching as dry etching process is performed from the surface side of the substrate having a thickness of 140 μm (a second substrate) 461 so that parts other than the torsion beam 442, a vibration plate 443 on which a planar coil is formed, reinforcing beams 444 constituting a framework of the moving section, and a frame 446 is removed to expose the oxide film. Next, anisotropic etching such as KOH is performed from the surface side of the substrate having a thickness of 60 μm (a first substrate) 462 so that parts other than the vibration mirror surface 441 and a frame 447 is removed to expose the oxide film. Lastly, the oxide film in the vicinity of the moving section is removed and separated to form a structure of the vibration mirror.

The width of the torsion beam 442 and the reinforcing beams 444 is in a range from 40 μm to 60 μm. As described above, to obtain a larger deflection angle, it is preferable to reduce the inertia moment I of the vibrator. On the other hand, the vibration mirror surface 441 may be deformed due to the inertia force. Therefore, in this embodiment of the present invention, the moving section has a skeleton structure. Further, aluminum thin film is evaporated on the surface side of the substrate having a thickness of 60 μm (a first substrate) 462 to form the reflection surface. On the surface side of the substrate having a thickness of 140 μm (a second substrate) 461, a coil pattern 463, terminals 464 wired through the torsion beam 442, and a patch 465 for trimming are formed of a copper thin film. A thin film permanent magnet may be provided on the vibration plate 443 side and a planar coil may be formed on the frame 447 side.

On the vibration mirror substrate 448, there are provided a frame-shaped pedestal (not shown) on which a vibration mirror 460 is mounted and a yoke 470 formed so as to surround the vibration mirror 460. On the yoke 470, there is bonded a pair of permanent magnet 450 having a North-pole permanent magnet and a South-pole permanent magnet. Each of the North-pole permanent magnet and a South-pole permanent magnet is disposed near one end of the moving mirror so that a magnetic field is generated in the direction orthogonal to the direction of the rotation axis of the torsion beam 442.

The vibration mirror 460 is mounted on the pedestal so that the vibration mirror surface 441 faces outwardly. By applying a current between the terminals 464, Lorentz force is generated on the lines of the coil pattern 463, the lines extending in the direction parallel to the axis direction of the torsion beam 442. Then, rotary torque T is generated to twist the torsion beam 442 to rotate the vibration mirror 460. When the current is cut, the vibration mirror 460 returns to its original horizontal position due to the restorative force of the torsion beam 442. Therefore, when the direction of the current applied to the coil pattern 463 is alternately changed, it becomes possible to move the coil pattern 463 back and forth.

By bringing the cycle of the alternate current closer to the natural frequency of the first vibration mode when the axis of the torsion beam 442 is the rotation axis, i.e., a resonant frequency f0, the amplitude is excited and a larger deflection angle may be obtained.

Therefore, normally, the scanning frequency fd has been set to this resonant frequency f0, or a control process has been performed so as to follow the resonant frequency f0. However, as described above, the resonant frequency f0 is determined depending on the inertia moment I of the vibrator constituting the vibration mirror. Because of this feature, when size accuracy of the products varies, individual sizes may vary and it may become difficult to manufacture vibration mirrors having the substantially same scanning frequency fd.

The variation of the resonant frequency f0 is in a range of ±200 Hz, though it may depend on the capability of the manufacturing process of the vibration mirror. In this case, for example, when fd=2 kHz, the scanning line pitch may be shifted by 1/10 line, and when an image is output on a A4-size sheet, the magnification error of several tens of millimeters may be detected at the end of the sheet.

To respond to this problem, the vibration mirrors are classified so that the vibration mirrors in the same class have similar values of the resonant frequency f0, and depending on the classes, an appropriate scanning frequency fd is selected and set up. However, when the resonant frequency f0 largely varies, it may become necessary to increase the number of the classes and accordingly increase the number of scanning frequency fd to be selected for the drive circuit of the vibration mirrors, thereby degrading the production efficiency. In addition, when the vibration mirror is required to be replaced, the vibration mirror is required to be replaced by the vibration mirror classified in the same class, thereby increasing the cost.

According to the embodiment of the present invention, the inertia moment l of the vibrator may be adjusted before being mounted on the mounting board by, for example, gradually making incisions in the patch 465 formed on the rear side of the moving section using carbon dioxide gas laser or the like to gradually reduce the mass of the moving section. Therefore, even when there is variation of sizes among each vibration mirror, it may become possible to adjust so that the resonance frequency f0 becomes substantially the same as each other, for example within a range of ±50 Hz.

Then, within the classified frequency band, a fixed scanning frequency fd may be set regardless of the resonant frequency f0.

Figure 7:
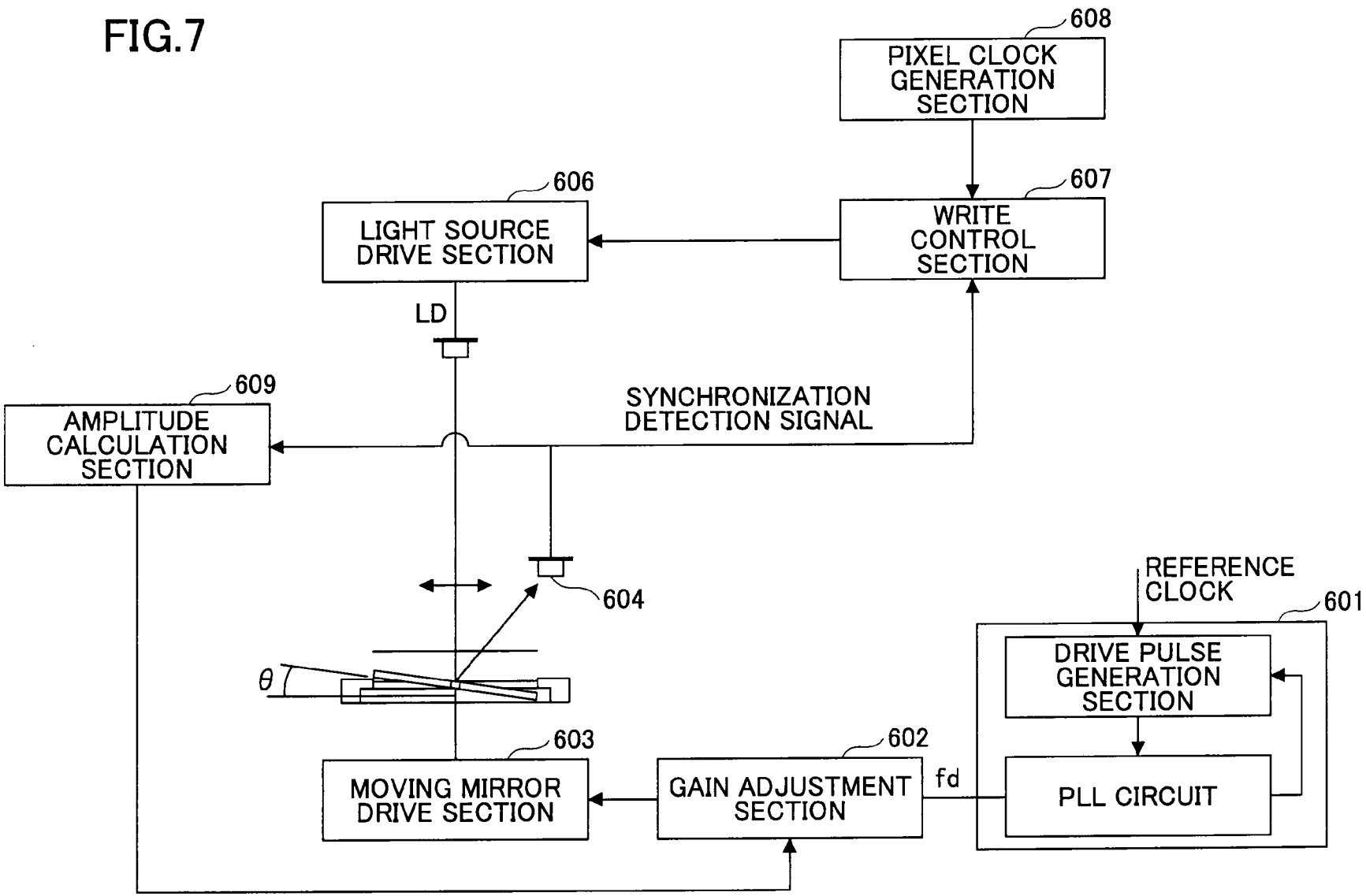
FIG. 7 is a block diagram showing an exemplary vibration mirror control circuit according to an embodiment of the present invention.

FIG. 7 is a block diagram showing an exemplary drive circuit for vibrating the vibration mirror at a predetermined amplitude. As shown in FIG. 7, the drive circuit includes a generation section 601 having a drive pulse generation section and a PLL circuit and generating a scanning frequency signal fd, a gain adjustment section 602, a moving mirror drive section 603, a synchronization detection sensor 604, a light source drive section 606, a write control section 607, a pixel clock generation section 608, and an amplitude calculation section 609. As described above, the moving mirror drive section 603 applies an alternate voltage or a pulse voltage to the planar coil formed on the rear side of the vibration mirror so that the direction of the applied current to the planar coil alternately changes. To set a deflection angle θ of the vibration mirror to be constant, based on a synchronization detection signal obtained by the synchronization detection sensor 604, the amplitude calculation section 609 calculates an appropriate amplitude of a signal to drive the vibration mirror and the gain adjustment section 602 adjusts the gain of the current to be applied to the planar coil to move the vibration mirror back and forth.

Figure 8:
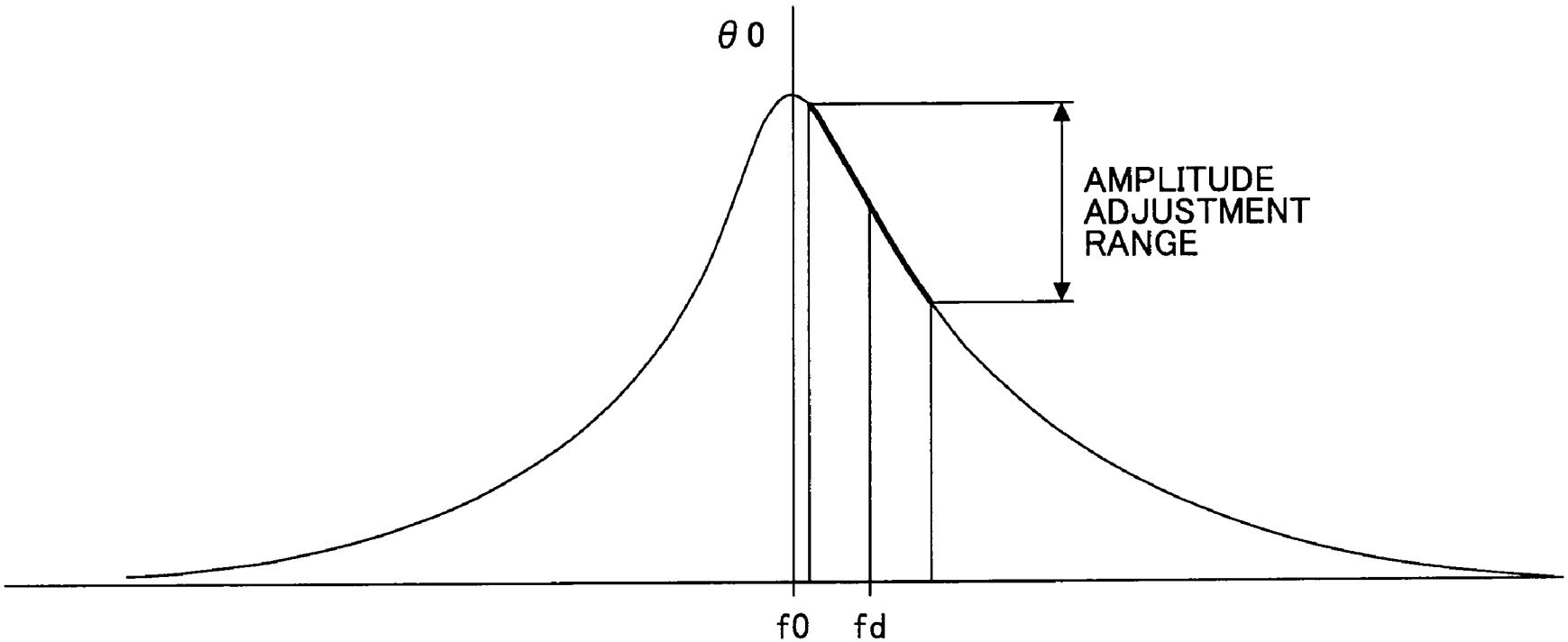
FIG. 8 is a waveform diagram showing a relationship between a frequency f to alternate the direction of the current to be flown through a planar coil of the vibration mirror and a deflection angle θ of the vibration mirror.

FIG. 8 is a graph showing a relationship between a frequency f to alternate the direction of the current applied to the planar coil and the deflection angle θ of the vibration mirror. Generally, the frequency characteristics of this graph has the peak at the resonant frequency f0 and the maximum deflection angle may be obtained by setting the scanning frequency fd to be equal to the resonant frequency f0. However, as shown in the graph, the deflection angle sharply changes around the resonant frequency f0.

Therefore, it may be possible to initially set a drive frequency (scanning frequency) applied to fixed electrodes in the drive control section of the vibration mirror so that the drive frequency applied to fixed electrodes corresponds to the resonant frequency. In this case, however, the deflection angle may drastically change when the resonant frequency changes due to, for example, the change of the spring constant as temperature changes. Therefore, this setting method may hardly provide stable behavior as time advances.

To overcome the drawback, according to an embodiment of the present invention, the scanning frequency fd is fixed to a single frequency which is separated from the resonant frequency f0, and the deflection angle θ may be increased/decreased in accordance with the gain adjustment. More specifically, when the resonant frequency f0 is 2 kHz, the scanning frequency fd is set to 2.5 kHz, and the deflection angle θ is adjusted to be in a range of ±25 degrees by the gain adjustment. As time advances, the deflection angle θ is detected based on the time difference between detection signals detected by the synchronization detection sensor 138 (upper side in FIG. 1) disposed near the start position of the scanning area in the forward scanning and the back scanning of the light beam scanned by the vibration mirror, and the control is performed so that the deflection angle θ becomes constant. By doing in this way, it may become possible to keep the deflection angle θ constant even when the temperature changes during the measurement, thereby enabling keeping the line speed of the light beam on the image surface substantially constant.

Figure 9:
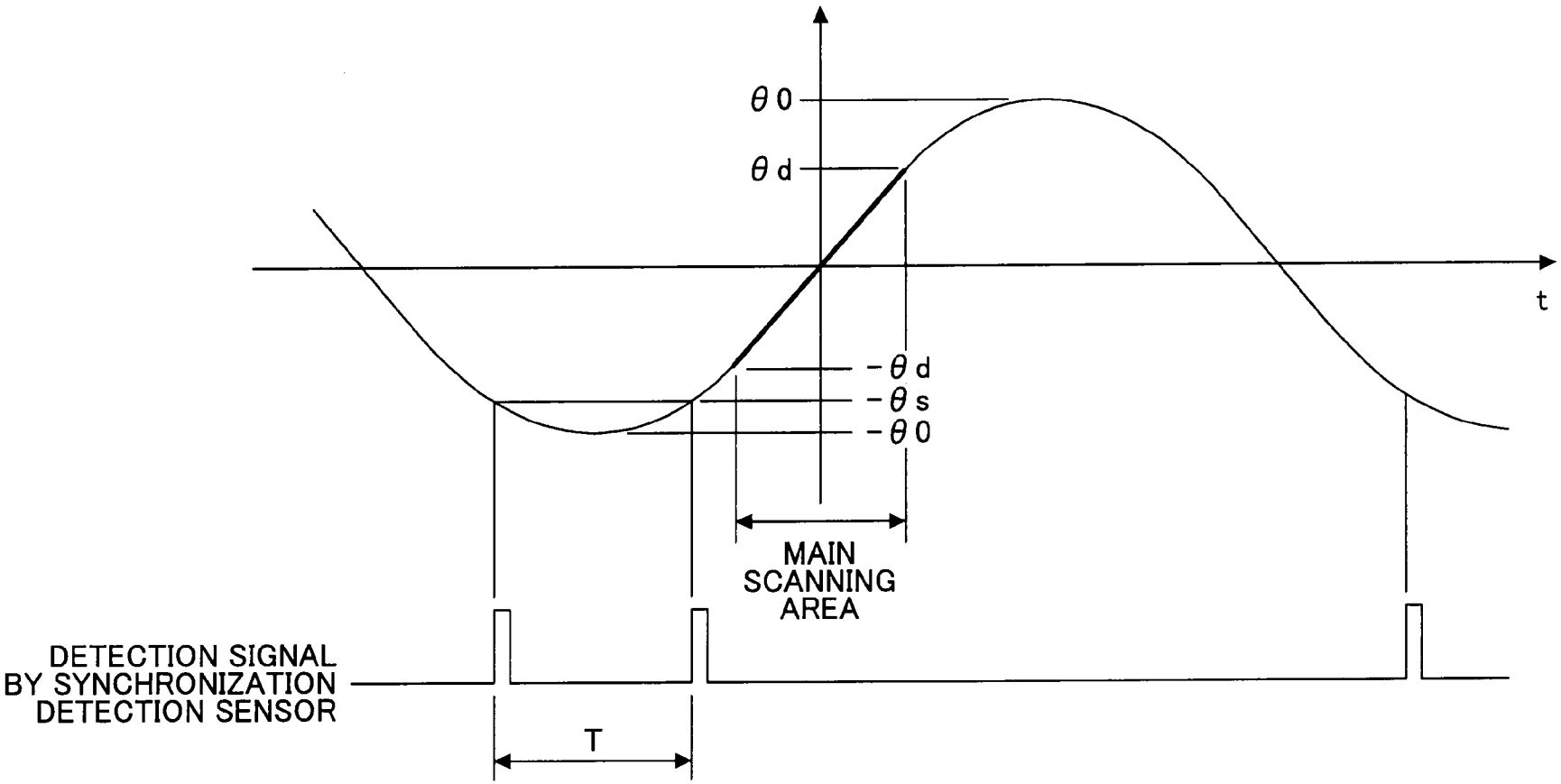
FIG. 9 is a waveform diagram showing a example of the change of the scanning angle of the vibration mirror over time.

As FIG. 9 shows, the scanning angle (deflection angle) θ of the vibration mirror changes like an amplitude of a sine wave as time t advances because the vibration mirror is resonantly vibrated. Therefore, when the amplitude (i.e., the maximum deflection angle) of the vibration mirror is denoted by θ0, the scanning angle is given as:

$$\theta=\theta 0\cdot \sin 2\pi fd\cdot t$$

When the synchronization detection sensor 138 detects the light beam corresponding to the scanning angle 2θs, the detection signal in the forward scanning and the detection signal in the back scanning are generated, and when the time difference between the detection signals is denoted by T, the scanning angle θs is given as:

$$\theta s=\theta 0\cdot \sin 2\pi fd\cdot T/2$$

This formula teaches that, since θs is constant, the maximum deflection angle θ0 may be determined when the time difference T can be measured.

During the period from when the light beam is detected in the forward scanning to when the light beam is detected in the back scanning, the deflection angle of the vibration mirror θ has the following relationships:

$$\theta 0>\theta>s$$

During this period, the emission of the light source is prohibited. On the surface (i.e. target scanning surface) of the photosensitive body drum, it is necessary to form dots in the main scanning direction so that the pixels have constant intervals therebetween over time.

Figure 10:
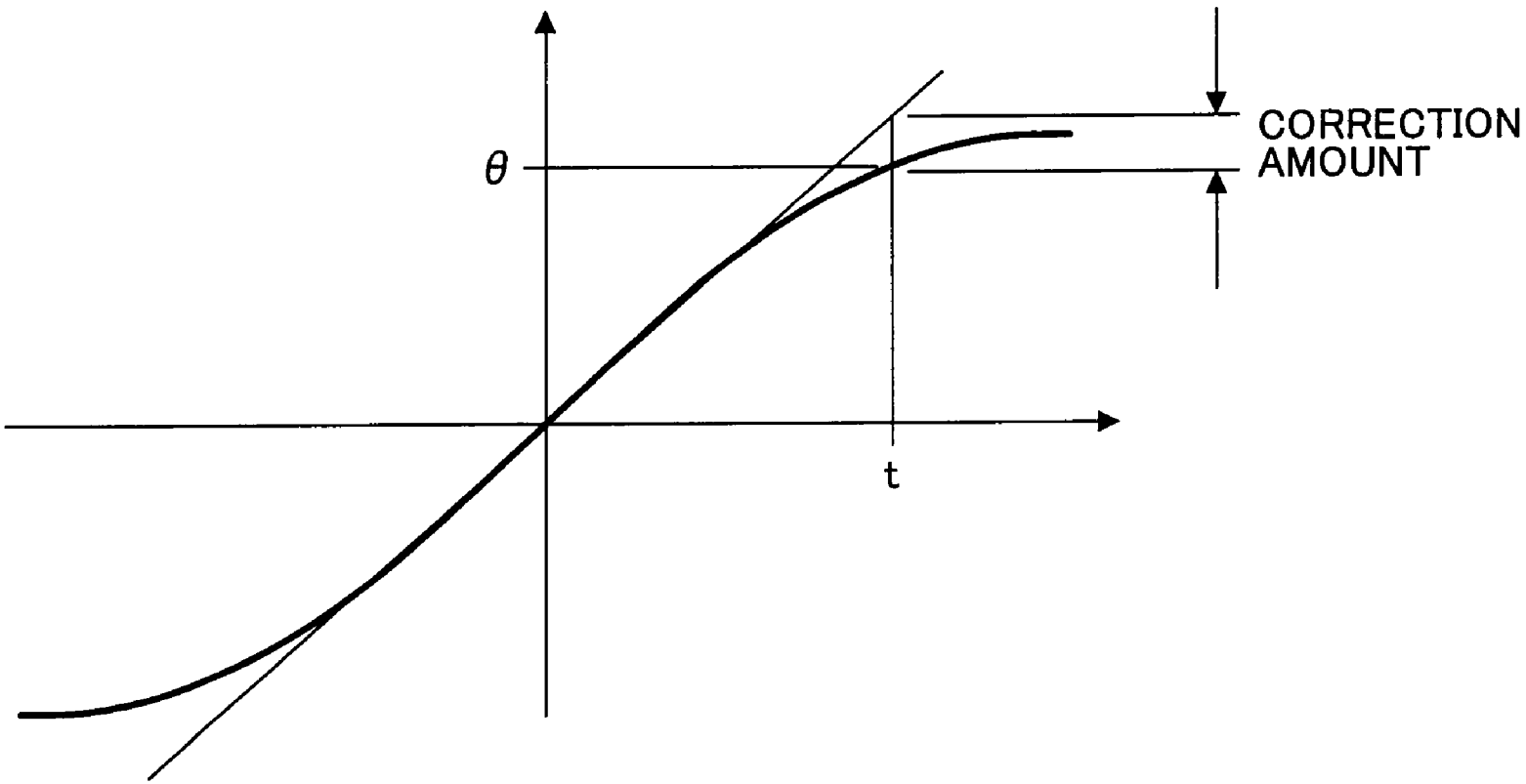
FIG. 10 is a waveform diagram showing an example of a rate of the change of the deflection angle of the vibration mirror over time.

As shown in FIG. 10, the rate of change of the deflection angle θ acceleratingly decreases as time advances. Therefore, the interval between the pixels becomes longer and longer on the target scanning surface as the light beam scans closer to each of both ends of the scanning area in the main scanning direction. Generally, this rate of change in the deflection angle θ may be corrected by using an f·arcsin lens. However, similar to a case where a polygon mirror is used for scanning, if the pixel clock is modulated at a single frequency, in order to arrange that the scanning angle 2θ is in proportion to time, i.e., the scanning angle 2θ changes in the same speed, it is necessary to set power (dioptric power) along the main scanning direction so that the correction value of the main scanning direction at the end of the main scanning area becomes the largest.

When symbol t denotes the period from when the image height is zero (0) to when the image height becomes H, the relationship between the image height H and the deflection angle θ (scanning angle 2θ) are given as:

$$H=\omega\cdot t=(\omega/2\pi fd)\cdot\sin^{-1}(\theta/\theta 0)$$

Where, the symbol ω denotes a constant.

However, when the difference of the intervals between the pixels, i.e., the correction value of so-called the linearity becomes larger, the deviation of the power along the main scanning direction of the scanning lens is increased and the deviation of the beam spot diameter corresponding to the pixels on the target scanning surface is also increased. Further, as described above, when the amplitude center of the vibration mirror does not correspond to the optical axis of the scanning lens, the scanning lens is required to have asymmetric curved surface with respect to the optical axis. To overcome the situation, in this embodiment of the present invention, the phase Δt of the pixel clock is changed in accordance with the main scanning position so that the deviation of the power of the scanning lens along the main scanning direction can be reduced as much as possible and also asymmetric components can be corrected.

Here, the symbol 2Δθ denotes the change of the scanning angle when the phase Δt of the pixel clock is changed, the following formulas expressing the relationships are given:

$$H=(\omega/2\pi fd)\cdot\sin^{-1}\{(\theta-\Delta\theta)/\theta 0\}$$

$$\Delta\theta/\theta 0=\sin 2\pi fdt-\sin 2\pi fd(t-\Delta t)$$

When the power distribution similar to that of the fθ lens is applied to the scanning lens and the residual error is corrected by the phase Δt of the pixel clock, the following formulas are obtained.

$$\begin{aligned} H &= (\omega/2\pi fd)\cdot\{(\theta-\Delta\theta)/\theta 0\} \\ &= (\omega/2\pi fd)\cdot\sin^{-1}(\theta/\theta 0) \\ \Delta\theta/\theta 0 &= \theta/\theta 0-\sin^{-1}(\theta/\theta 0) \end{aligned}$$

The pulse modulation is applied to the light source so that the phase Δt(sec) of the predetermined pixel along the main scanning direction is determined based on the following relationship:

$$(\theta/\theta 0)-\sin^{-1}(\theta/\theta 0)=\sin 2\pi fdt-\sin 2\pi fd(t-\Delta t)$$

Figure 11:
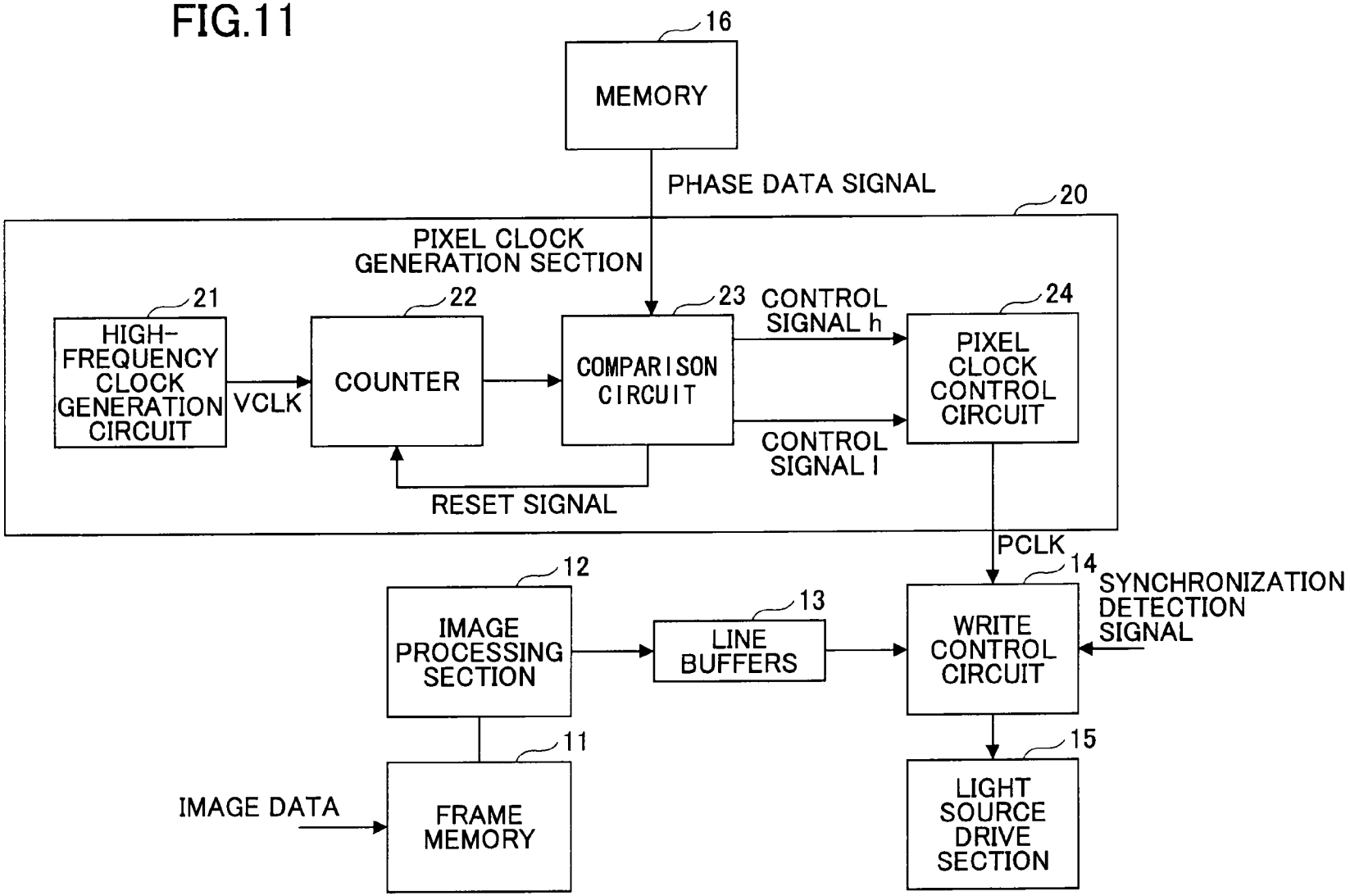
FIG. 11 is a block diagram showing an exemplary drive circuit to drive the laser diode of the light source used in an embodiment of the present invention.

FIG. 11 is a block diagram showing an exemplary drive circuit to modulate the laser diode of the light source. Image data are temporarily stored in a frame memory 11 and sequentially read to an image processing section 12, in which, while the anteroposterior relationships are referred to in a number of image data, image data corresponding to each line are formed in accordance with a matrix pattern corresponding to halftone imaging and transferred to line buffers 13. A write control circuit 14 reads each image data from the line buffers 13 by using the synchronization detection signal as a trigger and modulates independently.

Next, a clock generation section 20 modulating each light emission point is described with reference to FIG. 11. A high-frequency clock generation circuit 21 generates a high-frequency clock VCLK and a counter 22 counts the generated VCLK. A comparison circuit 23 compares the counted value with a set value L set in advance based on a duty ratio and phase data H indicating a phase shift amount given from an external memory 16 as a transition timing of the pixel clock. In the comparison circuit 23, when the counted value is equal to the set value L, a control signal 1 indicating the falling of a pixel clock PCLK is output, and when the counted value is equal to the phase data H, a control signal h indicating the rising of a pixel clock PCLK is output. In this case, the counter 22 is reset upon the output of the control signal h, and the count is resumed from zero (0), so that a consecutive pulse string may be formed. The control signal 1 and the control signal h are input to a pixel clock control circuit 24. Then, based on the control signals, the pixel clock control circuit 24 outputs the pixel clock PCLK to the write control circuit 14.

By doing in this way, by applying the phase data H per each clock cycle, the pixel clock control circuit 24 generates the pixel clock PCLK in which pulse cycle is sequentially changed. In this embodiment of the present invention, it is assumed that the frequency of the pixel clock PCLK is one eighth of that of the high-frequency clock VCLK and the phase can be changed by the resolution of ⅛ clock.

Figure 12:
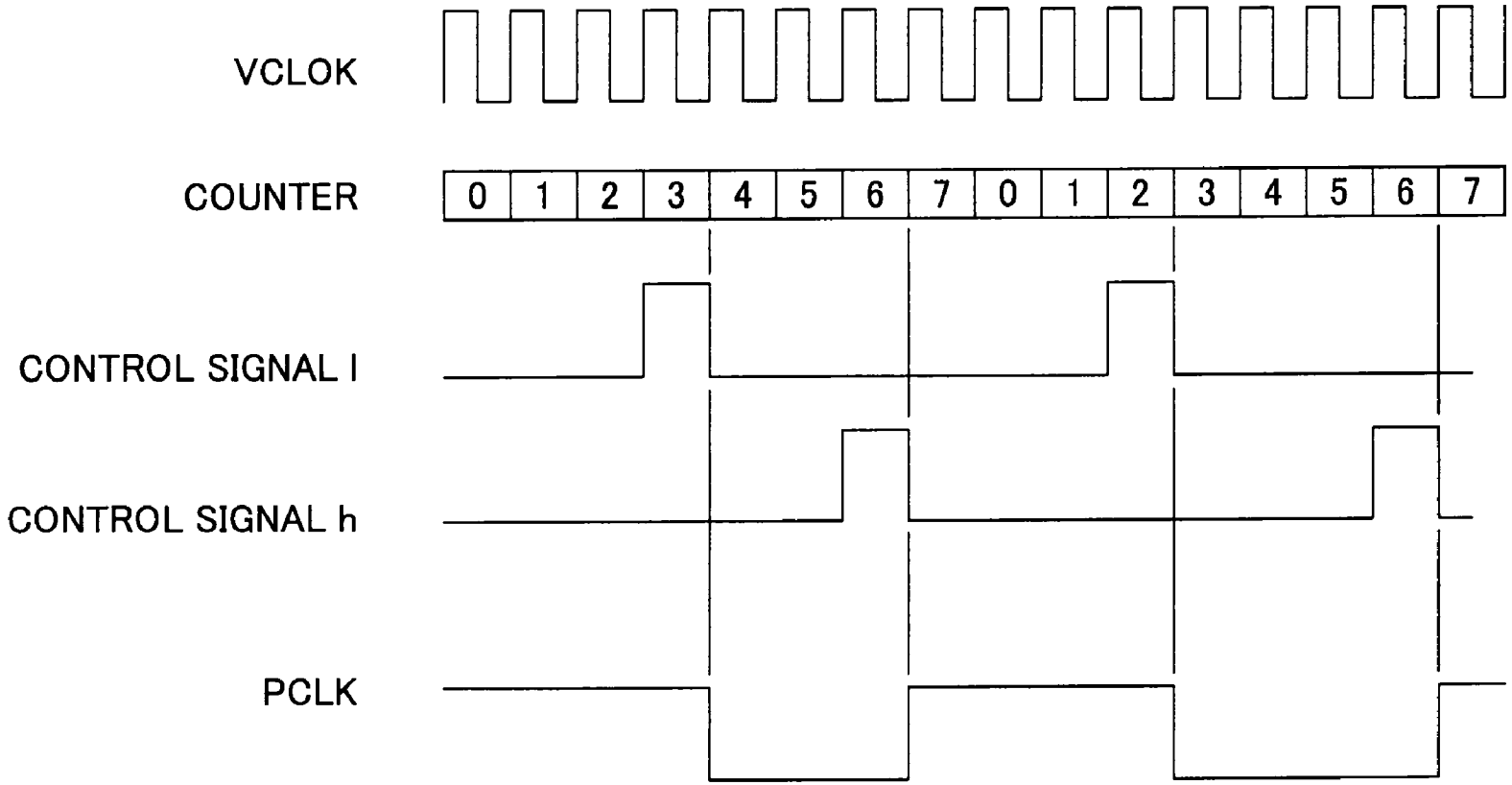
FIG. 12 is a time chart showing an exemplary operation of a drive circuit of the laser diode.

FIG. 12 shows an operation in which the phase of an arbitrary pixel is shifted and the phase is delayed by ⅛ clock only. When the duty is 50%, a set value L=3 is given, the counter counts four (4) counts, and the pixel clock rises up. To delay by ⅛ clock phase, the phase data H=6 is given, and the pixel clock rises up at seventh (7) count. At the same time, the counter is reset to zero, therefore, the pixel clock rises up at fourth (4) count again. As a result, the adjoining pulse cycle becomes shorter by ⅛ clock.

The pixel clock PCLK generated as described above is supplied to a light source drive section 15 shown in FIG. 11. Modulation data are generated by superimposing the image data read from the line buffers 13 on the pixel clock PCLK to drive the laser diode.

Figure 13:
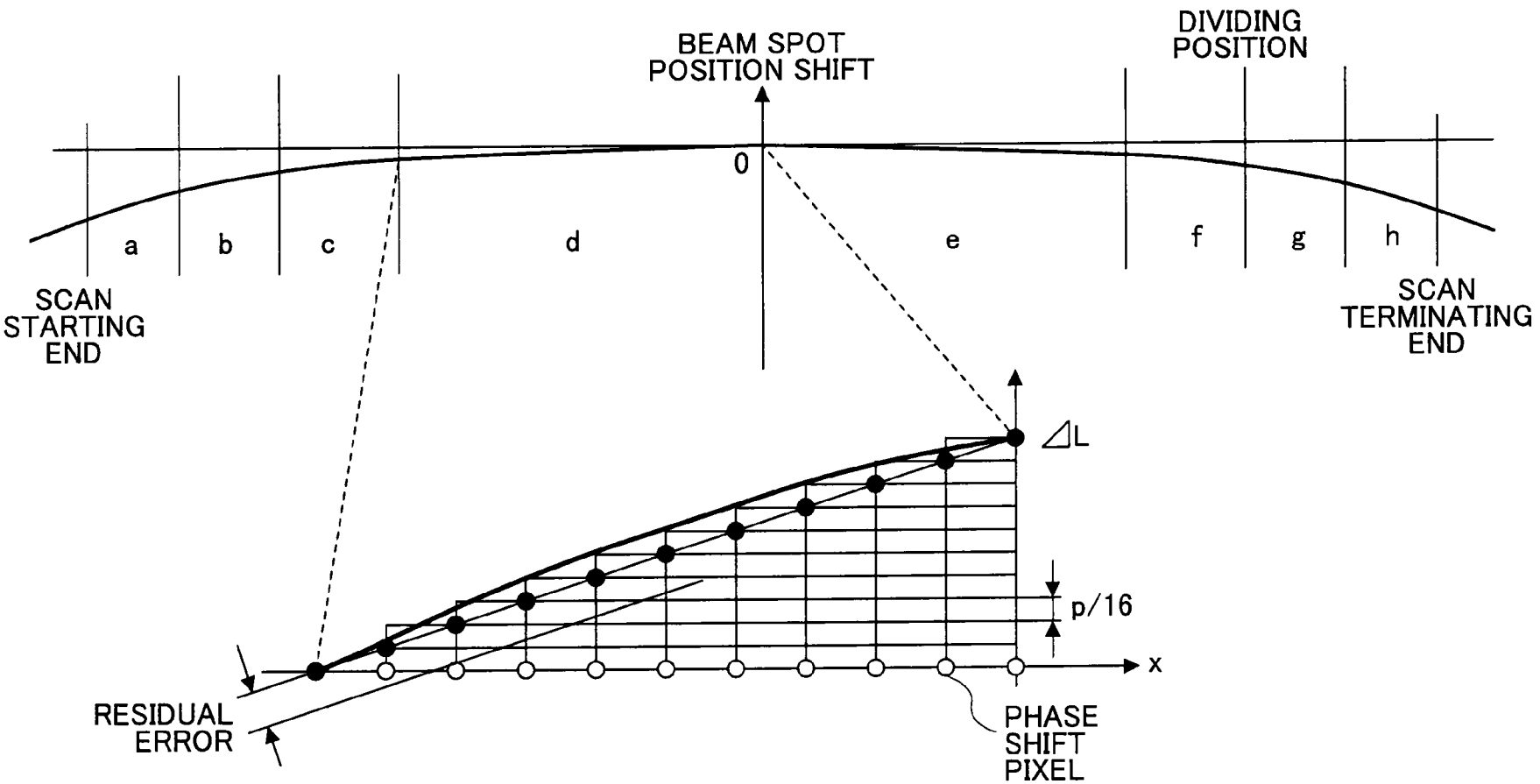
FIG. 13 is a graph showing an exemplary correction of main scanning position of each pixel in accordance with the main scanning position when modulated at a single frequency.

FIG. 13 shows each correction amount of the main scanning positions at the pixels when modulated at a single frequency. The main scanning area is divided into plural, in this example eight (8) (a through h), areas. A broken line approximation is performed, the number of phase shift of each area is set, and correction is performed in a step form so that the shift of the main scanning position at the ends of the areas becomes zero (0).

For example, when the symbol Ni denotes the number of i area, the resolution of the shift amount in each pixel is 1/16 of the pixel pitch p, and the symbol ΔLi denotes the shift of the main scanning position at both ends of each area, the following relationship is given:

$$ni=Ni\cdot p/16\Delta Li$$

Therefore, phase may be shifted in every ni pixels.

When the symbol fc denotes the pixel clock, the total phase difference Δt is expressed in the following formula by using the number of phase shift Ni/ni:

$$\Delta t=1/16fc\times\int(Ni/ni)di$$

The phase difference Δt at N dot can be determined by the number of the accumulation of the phase shift so far.

The width of the divided areas may be the same or different from each other, and the main scanning area may be divided by any number. However, when the shift amount becomes larger in each pixel, the step of the shift amount may become more recognizable. Therefore, preferably, correction is performed so that the shift amount becomes equal to or less than ¼ units of the pixel pitch p. On the other hand, when the phase shift amount becomes to small, the number of phase shift is increased and memory capacity to be used is increased. Further, the less the number of divisions, the less memory capacity is required. Therefore, it is preferable to narrow the width of the divided area where the shift amount of the main scanning position is relatively large and expand the width of the divided area where the shift amount of the main scanning position is relatively small.

Figure 14A:
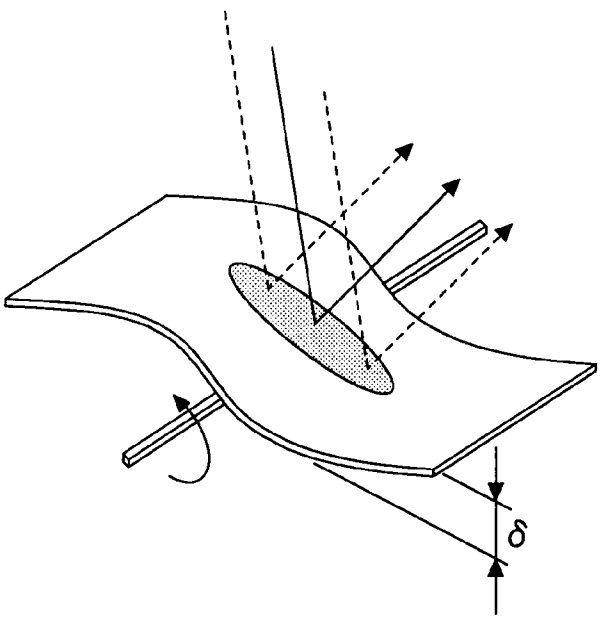
FIGS. 14A through 14C are optical path diagrams showing the reflection of light beams when the reflection surface of the vibration mirror is deformed around the rotary axis.
Figure 14B:
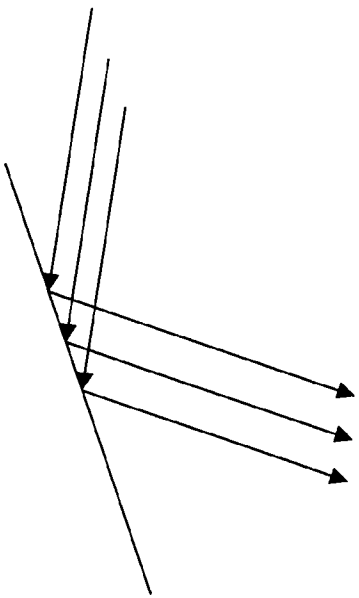
Figure 14C:
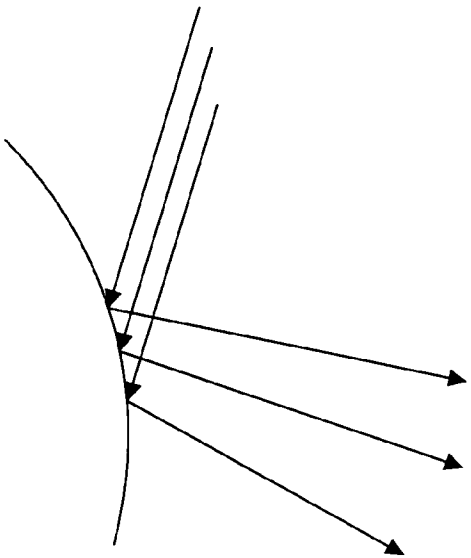

FIGS. 14A through 14C are figures for illustrating a δ deformation of the reflection surface of the vibration mirror around the rotary axis. For example, the reflection surface (vibration mirror surface) 441 of the vibration mirror is convexly deformed as shown in FIG. 14C, collimated light beams are outwardly deflected after being reflected by the reflection surface 441, thereby causing the degradation of an image on the image surface due to beam waist flattening and the like. Further, the feedback light reflecting on the vibration mirror may be fed back to the light source in a wider range than the incident angle α. Therefore, it may be preferable to somewhat extend the light emission amount control period in which the light beam is forcibly turned OFF or not to perform APC when the laser light is unable to be turned OFF, thereby enabling stably emitting light from the laser diode.

Therefore, when the deformation of the reflection surface of the vibration mirror is expected, it may become possible to obtain light beams having substantially a constant diameter with each other by adding a pulse modulation drive in the light source section so that the beam waist flattening can be corrected. Further, to perform real-time correction, it may be necessary to provide a calculation section to calculate an appropriate pulse drive correction method based on the change of the time interval of the passage of the light beam in the synchronization detection process and the information of beam profile obtained at a detection surface. At the same time, it may be necessary to provide another calculation section to similarly calculate appropriate pulse drive correction method for determining the start position, stop position, and the period of the light emission amount control period in which the light beam is forcibly turned OFF.

Figure 15:
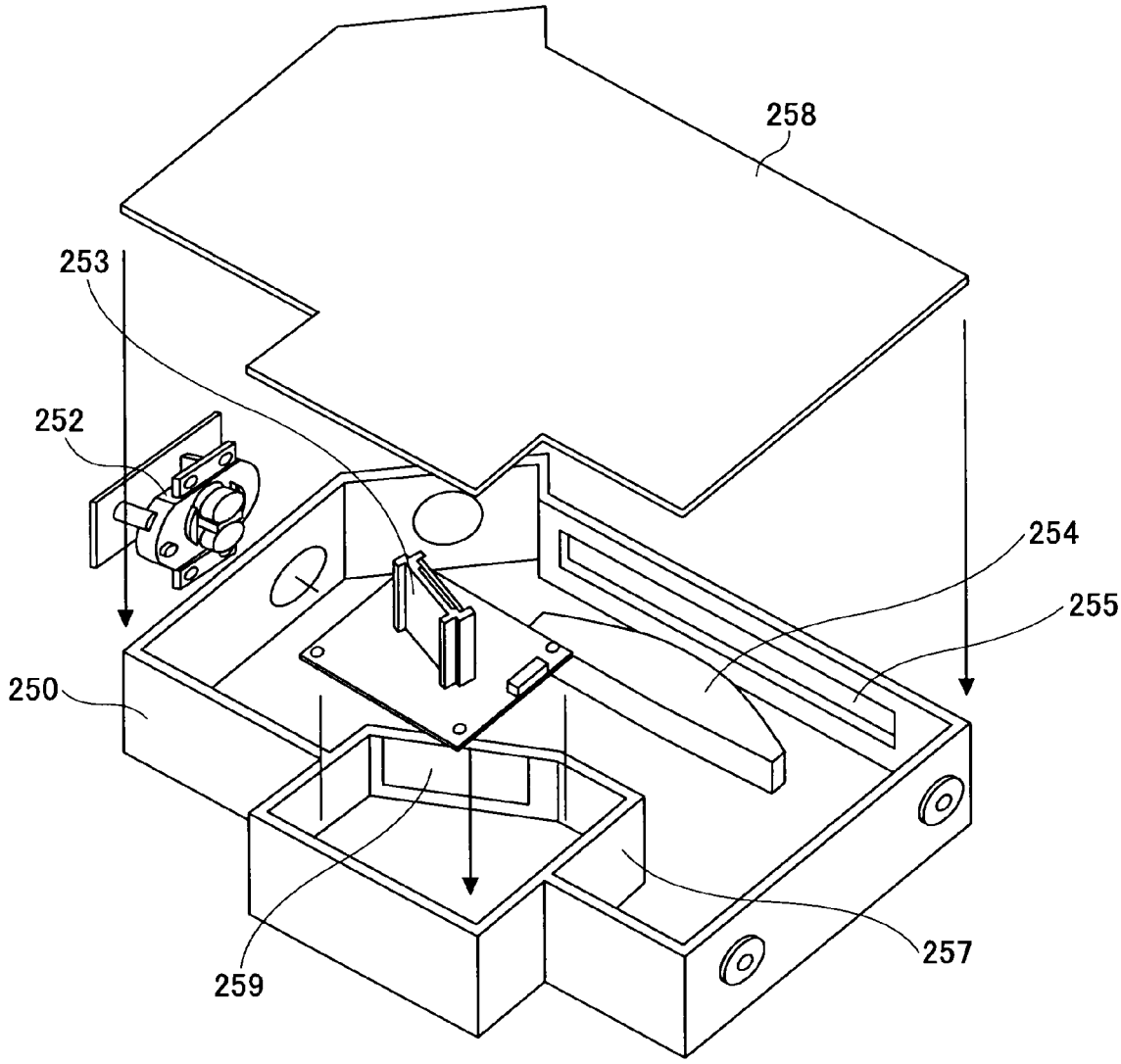
FIG. 15 is an explored perspective view showing an exemplary housing to be used for an optical scanning device according to an embodiment of the present invention.

FIG. 15 shows an exemplary housing of the optical scanning device. In FIG. 15, the reference numeral 253 denotes a vibration mirror module including a vibration mirror surface 441 (see FIG. 6D), the mounting board 440, the frame-shaped supporting member 445 and the like. The vibration mirror module 253 is mounted in an optical housing including a side wall 257 integrated in the optical housing and surrounding the vibration mirror module 253. The upper end rim of the side wall 257 is sealed by an upper cover 258, thereby isolating the vibration mirror module 253 from outside air to prevent the change of the amplitude due to convection of outside air. Further, the side wall 257 includes an opening section through which the light beam is emitted into and from the vibration mirror of the vibration mirror module 253. A translucent window member 259 is inserted in the opening section. In FIG. 15, reference numerals 250 and 252 denote a housing main body and a light source unit, respectively. The light beam deflected by the vibration mirror passes through an fθ lens that is fixed to the vibration mirror module 253 and that constitutes a scanning image optical system and emits through a beam passage frame 255 formed on a peripheral wall of the housing main body 250.

FIG. 16 shows an exemplary image forming apparatus on which the optical scanning device shown in FIG. 1 is mounted. The reference numeral 900 denotes the optical scanning device. In FIG. 16, in the vicinity of each of the photosensitive body drums, there are disposed a charger 902 charging the photosensitive drum to high voltage, a developing device 904 adhering charged toner to a latent image recorded by scanning a light beam to visualizing the latent image, and a cleaning device 905 wiping off and storing residual toner on the photosensitive body drum. To each of the photosensitive body drums, two lines of image data are recorded in one cycle of scanning operation including back and forth scanning of the vibration mirror. One photosensitive body drum and other units disposed in the vicinity of the photosensitive body drum constitute a single image forming station, and four such image forming stations align along the traveling direction of an intermediate transfer belt 905. The four image forming stations form yellow, magenta, cyan, and black images, respectively, and formed toner images are sequentially transferred onto the intermediate transfer belt 905 at each synchronized timing and superimposed to form a color image. The configurations of the four image forming stations are basically the same except for the color of toner.

At the bottom of the image forming apparatus, there is provided a loading section for a sheet tray 907 containing recording sheets as recording media. The recording sheets are picked up one by one by a pick-up roller 908 and fed by a resist roller pair 909 at the timing when recording starts in the sub scanning direction, so that the toner image is transferred from the intermediate transfer belt 905. When the transferred sheet onto which the toner image is transferred passes through a fixing device 910, the toner image is fixed onto the transfer sheet and the transfer sheet is discharged to a discharge tray 911 by a discharge roller pair 912.

According to an embodiment of the present invention, the light beam emitted from the light source is forcibly turned OFF during a period (light emission amount control period) other than the image forming period. By doing this way, it may become possible to prevent a light beam reflected by the reflection surface of the vibration mirror from being fed back (as the feedback light) to the light emitting section of the light source when the maximum deflection angle of the vibration mirror is greater than the incident angle of the light beam emitted from the light source means to the reflection surface of the vibration mirror. For example, the light emission amount may be reduced by controlling drive pulse applied to the laser diode of the light source.

According to an embodiment of the present invention, by controlling the effective scanning ratio (θd/θ0) which is the ratio of the deflection angle θd scanning in a scanning area to the amplitude θ0 and adjusting so that the light beam incident position to the reflection surface of the vibration mirror is disposed on the rotary axis in the image scanning optical system, it may become possible to provide an optical scanning device and an image forming apparatus including the optical scanning device capable of reducing the degradation of the wave aberration of the flux of the light beams reflected by the reflection surface of the vibration mirror and beam spot diameter and forming high-quality images. Further, it may become possible to detect light emitting conditions and control the light emission amount control period in which the light beam is forcibly turned OFF based on the detected light emitting conditions.

According to an embodiment of the present invention, based on the relationship between the disposed position of the synchronization detection means and the installed position of the detection surface for detecting the scanned light beam, it may become possible to calculate the number of dots between the disposed position and the installed position, reset the dot counter of the light source drive means when the light beam passes on the synchronization detection means, and appropriately set the write start position and write stop position in accordance with the operating condition of the vibration mirror.

Further, based on the change of the detected time period from the synchronization detection of the scanned light beam to the detection surface, the change of the deflection angle due to the temperature change of the vibration mirror may be detected. Further, by controlling the drive current and drive frequency to the vibration mirror, it may become possible to control to appropriately set the start position and the stop position of the light emission amount control period in which the light beam is forcibly turned OFF or the light emission amount control period in which the drive current is set to be equal to or less than a predetermined value, the dot intervals, and the counter value. By doing in this way, it may become possible to form stable beam spots on the target scanning surface.

According to an embodiment of the present invention, it may become possible to adjust the values of the light emission amount control period in which the light beam is forcibly turned OFF in response to the change of the scanning condition of the vibration mirror due to disturbances of temperature, humidity and the like based on the synchronization detection signal detected by the light beam detection means, or adjust the values of the light emission amount control period to desirable values in response to the change of the vibration conditions caused by the disturbance of the vibration mirror as a deflection means or change over time by adjusting the timings and duration of the light emission amount control period in which the drive current is reduced to a level equal to or less than a predetermined level.

According to an embodiment of the present invention, the vibration mirror supported by the torsion beam is used as an optical deflector and back and forth scanning is performed using the vibration mirror. By doing in this way, when compared with a case where a polygon mirror or the like is used as the optical deflector, it may become possible to reduce heat generation, noise, and energy consumption.

According to an embodiment of the present invention, by sequentially drive scanning the plural light sources and performing the APC drive, it may become possible to stably emit the light source without being affected by the feedback light from the other light emitting sections of the light source.

According to an embodiment of the present invention, when the light source has plural light emitting sections and the light beam emitted from a light emitting section may become the feedback light incident to another light emitting section, by independently setting the light emission amount control period in which the light beam is forcibly turned OFF or the drive current is reduced to a level equal to or less than a predetermined level with respect to each of the light emitting sections, it may become possible to perform appropriate APC without being affected by the feedback light from another light emitting section, thereby enabling stable light emission of the laser diode of the light source.

According to an embodiment of the present invention, it may become possible to adjust to have a desired maximum deflection angle by controlling so that the maximum amplitude becomes constant by the deflection control means based on the detection signal of the scanned light beam even when the maximum deflection angle is changed due to disturbance of the vibration mirror or continuous operation.

According to an embodiment of the present invention, even when the light emission amount control period or the drive current of the vibration mirror is changed due to the change of the scanning frequency caused by the disturbance or continuous operation, it may become possible to appropriately change the settings of the light emission amount control period so that the change is controlled to be reduced to a level equal to or less than a predetermined level by changing the timings and time settings in response to the scan frequency calculated based on the detection signal of the scanned light beam. By doing in this way, it may become possible to control the influence of the feedback light and form a high-quality image on the target scanning surface.

According to an embodiment of the present invention, even when the light emission amount control period or the drive current of the vibration mirror is changed due to the change of the scanning frequency caused by the disturbance or continuous operation, it may become possible to calculate the shift amount of the amplitude center of the deflection means based on the detection signals by the light beam detection means provided each on both sides provided on the outside of the image forming area, appropriately change the settings of the light emission amount control period based on the calculation results, control the influence of the feedback light, and form a high-quality image on the target scanning surface. When the amplitude center of the vibration mirror is shifted, it may become possible to determine whether the amplitude center is shifted in the + image height direction or in the – image height direction by comparing the time difference of the signal detected at both end sides which is outside the image forming area, so that the light emission amount control period in which the light beam is forcibly turned OFF or the drive current is reduced to a level equal to or less than a predetermined level can be appropriately controlled.

In an image forming apparatus according to an embodiment of the present invention, by employing an optical scanning device according to an embodiment of the present invention as the optical scanning device, it may become possible to form a high-quality image by a stable light source that is not affected by the feedback light. Further, in the full-color image forming apparatus according to an embodiment of the present invention, it may become possible to reduce color drift and color shading and form a high-quality color image.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. An optical scanning device comprising:

a light source unit having a light emitting section that emits a light beam;

a light source drive unit configured to modulation drive the light source unit;

a deflection unit configured to deflect the light beam emitted from the light source unit and scan in a main scanning area;

a scanning image optical system having an optical axis and configured to guide the light beam from the deflection unit onto a target scanning surface; and a light beam detection unit having one or more detection surfaces to detect the light beam from the deflection unit, wherein the light source drive unit is configured to control an amount of light emission of the light source unit, wherein the deflection unit is configured to deflect the light beam so that a maximum deflection angle of a reflection surface of the deflection unit relative to the optical axis is greater than an incident angle of the light beam emitted from the light source unit to the reflection surface of the deflection unit relative to the optical axis, and wherein the light source drive unit is configured to control timings and a time period of a light emission amount control period where the light source unit is forcibly turned off by measuring a change of an deflection angle of the deflection unit based on a detection signal from the light beam detection unit, the light emission control period including a timing corresponding to an angle where the light beam reflected by the deflection unit returns to the light source unit.

2. An optical scanning device comprising:

a light source unit having a light emitting section that emits a light beam;

a light source drive unit configured to modulation drive the light source unit;

a deflection unit configured to deflect the light beam emitted from the light source unit and scan in a main scanning area;

a scanning image optical system having an optical axis and configured to guide the light beam from the deflection unit onto a target scanning surface; and a light beam detection unit having one or more detection surfaces to detect the light beam from the deflection unit, wherein the light source drive unit is configured to control an amount of light emission of the light source unit, wherein the deflection unit is configured to deflect the light beam so that a maximum deflection angle of a reflection surface of the deflection unit relative to the optical axis is greater than an incident angle of the light beam emitted from the light source unit to the reflection surface of the deflection unit relative to the optical axis, and wherein the light source drive unit is configured to control timings and a time period of a light emission amount control period where a driving current to the light source unit is less than or equal to a predetermined value by measuring a change of an deflection angle of the deflection unit based on a detection signal from the light beam detection unit, the light emission control period including a timing corresponding to an angle where the light beam reflected by the deflection unit returns to the light source unit.

3. The optical scanning device according to claim 1, wherein the light source unit includes plural light emitting sections, each of the light emitting sections is sequentially turned ON in the non-image forming period excluding the light emission amount control period in which the light source unit is forcibly turned OFF, and the amount of light of the light beam emitted from the light emitting section is adjusted by performing automatic power control (APC).

4. The optical scanning device according to claim 1, wherein the light source unit includes plural light emitting sections, and the light emission amount control period in which the light source unit is forcibly turned OFF is set to each of the light emitting sections.

5. The optical scanning device according to claim 2, wherein the light source unit includes plural light emitting sections, and the light emission amount control period in which the drive current to the light source unit is reduced to the level equal to or less than the predetermined level is set to each of the light emitting sections.

6. The optical scanning device according to claim 1, further comprising:

a deflection control unit configured to control the deflection unit so that a maximum amplitude of the deflection unit becomes substantially constant based on a detection signal detected by the light beam detection unit.

7. The optical scanning device according to claim 2, further comprising:

a deflection control unit configured to control the deflection unit so that a maximum amplitude of the deflection unit becomes substantially constant based on a detection signal detected by the light beam detection unit.

8. The optical scanning device according to claim 1, wherein the light source drive unit sets timings and duration in accordance with a scanning frequency of the deflection unit, the scanning frequency being calculated based on a detection signal detected by the light beam detection unit.

9. The optical scanning device according to claim 2, wherein the light source drive unit sets timings and duration in accordance with a scanning frequency of the deflection unit, the scanning frequency being calculated based on a detection signal detected by the light beam detection unit.

10. The optical scanning device according to claim 1, wherein the light source drive unit sets timings and duration in accordance with a shift amount of an amplitude center of the deflection unit, the shift amount being calculated based on a detection signal detected by the light beam detection unit.

11. The optical scanning device according to claim 2, wherein the light source drive unit sets timings and duration in accordance with a shift amount of an amplitude center of the deflection unit, the shift amount being calculated based on a detection signal detected by the light beam detection unit.

12. An image forming apparatus comprising:

at least one image carrier; and processing units disposed in relation to the image carrier and including an optical scanning device according to claim 1.

13. An image forming apparatus comprising:

at least one image carrier; and processing units disposed in relation to the image carrier and including an optical scanning device according to claim 2.

* * * * *

UNITED STATES PATENT AND TRADEMARK OFFICE

CERTIFICATE OF CORRECTION

PATENT NO. : 8,363,297 B2
APPLICATION NO. : 12/396744
DATED : January 29, 2013
INVENTOR(S) : Masahiro Soeda et al.

It is certified that error appears in the above-identified patent and that said Letters Patent is hereby corrected as shown below:

On the title page, Item (73), the Assignee information is incorrect. Item (73) should read:

--(73) Assignee: Ricoh Company, Ltd., Tokyo (JP)--

Signed and Sealed this
Second Day of April, 2013

Teresa Stanek Rea
*Acting Director of the United States Patent and Trademark Office*